United States Patent [19]

Beckett

[11] Patent Number: 4,545,175

[45] Date of Patent: Oct. 8, 1985

[54] PROGRAMMABLE RANDOM SIZE CASE SEALING MACHINE

[75] Inventor: Joel M. Beckett, Eatonville, Wash.

[73] Assignee: Marq Packaging Systems, Inc., Yakima, Wash.

[21] Appl. No.: 452,313

[22] Filed: Dec. 22, 1982

Related U.S. Application Data

[63] Continuation-in-part of Ser. No. 388,655, Jun. 15, 1982, Pat. No. 4,517,784, and a continuation-in-part of Ser. No. 435,363, Oct. 20, 1982, Pat. No. 4,515,579.

[51] Int. Cl.[4] ..... B65B 7/20; B65B 57/02

[52] U.S. Cl. ..... 53/69; 53/76; 493/1; 493/35

[58] Field of Search ..... 53/69, 67, 76, 75; 493/30, 21, 23, 35, 1, 2

[56] References Cited

U.S. PATENT DOCUMENTS

| | | | |
|---|---|---|---|
| 3,364,827 | 1/1968 | Schmitz et al. | 493/2 |
| 3,775,937 | 12/1973 | Devan et al. | 53/75 |
| 3,885,372 | 5/1975 | Peres | 53/75 |
| 3,894,380 | 7/1975 | Poulsen | 53/75 |
| 3,973,375 | 8/1976 | Loveland | 53/75 X |

*Primary Examiner*—James F. Coan

*Attorney, Agent, or Firm*—Christensen, O'Connor, Johnson & Kindness

[57] ABSTRACT

A machine for sealing the top and/or bottom flaps of random size cases is disclosed. The location of the front and rear of cases moved through the machine by a conveyor is continuously monitored by a programmable controller that uses the location information to control the operation of various case alignment, flap folding, and glue-applying mechanisms. Case entry is initially prohibited by a raised gate. When the conveyor reaches a predetermined position the gate is lowered and a case enters the machine. As a case enters the machine, the case is aligned along the center of the case path of travel through the machine; and a T-deck drops to allow the bottom major flaps to separate from the bottom minor flaps. Such separation is necessary for the bottom flaps to be sealed simultaneously with the top flaps. If the bottom flaps are sealed when the case enters the machine, no separation occurs. As the case continues to move through the machine, a kicker carriage is lowered, top rails (mounted on the kicker carriage) are moved inwardly and a kicker (also mounted on the kicker carriage) is actuated. As a result, the upper minor flaps of the case are first folded, followed by a partial folding of the upper major flaps. The case is then moved past top and bottom glue heads that apply glue (if programmed to do so) to the top and bottom flaps at front and rear locations in an operator programmed (continuous or intermittent) pattern. The length of the glue pattern is also operator programmable. After the glue is applied, the case moves under a compression carriage that is lowered to apply vertical pressure that causes the major flaps to adhere to the minor flaps in regions where glue is applied by the glue heads. As the case moves beneath the compression carriage discharge rails are moved inwardly to maintain the case alignment. After each of their functions has been performed, the various movable mechanisms (the infeed, top and discharge raisl, and the kicker and compression carriages) are repositioned for the next case being moved through the machine. In this regard, two cases may be sequentially moved through the machine by the conveyor mechanism, with the front and rear of both cases being continuously monitored by the programmable controller.

25 Claims, 23 Drawing Figures

GLUE-STITCH PROGRAM SUBROUTINE

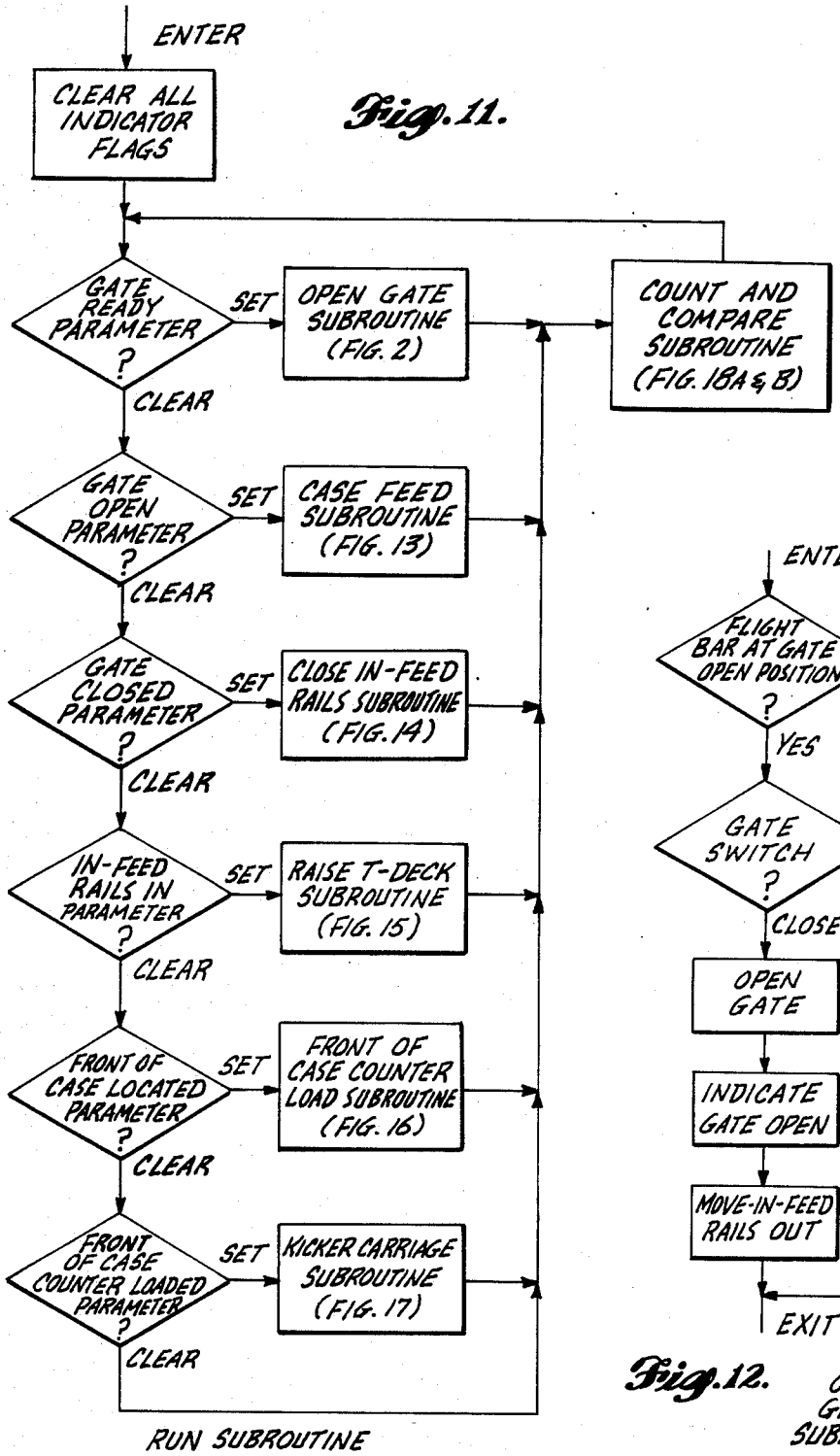
Fig. 11.
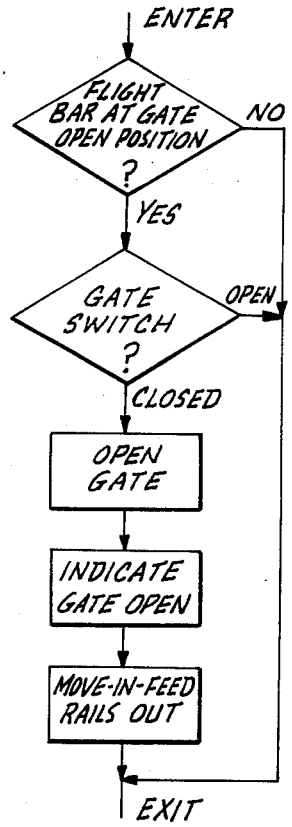
Fig. 12. OPEN GATE SUBROUTINE

FRONT OF CASE COUNTER COMPARE SUBROUTINE

PROGRAMMABLE RANDOM SIZE CASE SEALING MACHINE

RELATIONSHIP TO OTHER APPLICATIONS

This application is a continuation-in-part of both U.S. patent application Ser. No. 388,655 filed June 15, 1982, now U.S. Pat. No. 4,517,784 and entitled: "Programmable Case-Sealing Machine"; and U.S. patent application Ser. No. 435,363, filed Oct. 20, 1982, now U.S. Pat. No. 4,515,579 and entitled: "Programmable Case Set-Up and Bottom Sealing Machine."

TECHNICAL AREA

This invention is directed to case-handling machines and, more particularly, to case-sealing machines.

BACKGROUND OF THE INVENTION

In the past, various types of case-handling machines have been developed. Case-handling machines include machines for erecting cases, machines for sealing cases and machines for placing inserts in cases, plus various combinations thereof. For example, some case-handling machines both erect cases and, then, partially seal the erected cases. Other case-handling machines merely seal cases. In some machines, sealing is accomplished using an adhesively coated tape. In other machines, an adhesive is applied directly to the major and/or minor flaps of the case to be sealed. In some machines, both the bottom and the top of the cases are sealed after the case has been loaded with the object or objects to be stored in the case. In such machines, the case is partially assembled and, then, loaded prior to entering the machine. More specifically, the case is erected and the bottom major flaps folded over the bottom minor flaps. The top major and minor flaps of the case are left upstanding. The objects are loaded into the case as the case is supported on a suitable supporting medium, such as a conveyor. Thereafter, the case is conveyed to the case sealing machine, which simultaneously seals the bottom flaps of the case as the top flaps are being folded and sealed. The present invention relates to the latter type of case sealing machines, i.e., case sealing machines having the capability of simultaneously sealing both the top and bottom flaps of cases, or sealing either the top or the bottom flaps of cases, as desired. More specifically, the present invention relates to case sealing machines having the capability of simultaneously sealing both the top and bottom flaps of random size cases, or sealing either the top or the bottom flaps of such cases, as desired.

In the past, case sealing machines designed to seal both the top and/or bottom of cases (regardless of whether the cases were required to be of fixed size or could be randomly sized) have been either manually controlled or semi-automatically controlled by an electromechanical mechanism that includes a plurality of sensing switches actuated by lever arms impinged on by the case, as the case is moved through the machine. Manually controlled machines are undesirable because they are both slow and labor-intensive. Semi-automatically controlled electromechanical machines have a number of other disadvantages. First, because sealing machines use glue to seal cases, glue is often spattered. Because of their location, glue is ocassionally spattered on sensing switches, resulting in incorrect machine operation. When this occurs, the machine must be shut down and corrective cleaning and/or repair steps taken.

Another major disadvantage of prior art electromechanically controlled case sealing machines is the difficulty attendant to changing the manner of operation of such machines. Usually a switch arm and/or a timing wheel peg must be repositioned in order to change the operation of one of the machine mechanisms (e.g., glue heads, kicker, case-aligning rails, etc.) Such changes require the services of tools and mechanics, and result in machine down-time. Machine down-time is undesirable for two reasons—the costs of the related machine adjustment and/or repairs; and, resultant idle time of the machine operator and employees filling the cases being sealed by the machine.

Thus, there is a need for case sealing machines that use a minimum number of position-sensing switches, yet can be easily programmed to selectively seal the top, bottom, or both the top and bottom of a case as the case is moved through the machine. In particular, there is a need for such a case sealing machine that is suitable for sealing the top, bottom or both the top and bottom of random size cases as such cases are moved through the machine. The present invention is directed to providing such a machine.

SUMMARY OF THE INVENTION

In accordance with this invention, a programmable case sealing machine for selectively sealing the top and/or bottom flaps of random size cases is provided. The case sealing machine includes a programmable controller that continuously monitors the location of the front and rear of cases moving through the machine and, based on such location information, controls the operation of flap folding, case alignment, and glue-applying mechanisms forming part of the case sealing machine. Case entry is prevented by a gate mechanism until a case movement mechanism reaches a predetermined position. After a case is fed into the machine it is moved through the machine by the case movement mechanism. As the case enters the machine it is aligned by an infeed alignment mechanism. If the bottom of the case is to be sealed, the bottom major flaps are allowed to separate from the bottom minor flaps. As the case proceeds through the machine, a kicker carriage is lowered and mechanisms mounted on the kicker carriage fold the front top minor flap rearwardly, kick the rear top minor flap forwardly and, then, partially fold the top major flaps. Top and bottom glue heads apply glue (if programmed to do so) to the top and bottom flaps in a programmed pattern. After the glue is applied, the top major flaps are folded over the top minor flaps (and the bottom major flaps are folded under the bottom minor flaps, if the case bottom is being sealed) as the case is moved under a compression carriage that is lowered to apply vertical pressure to the flaps. The vertical pressure causes the major flaps to adhere to the minor flaps in the region where glue is applied by the glue heads. As the case moves beneath the compression carriage, a discharge alignment mechanism maintains the case aligned under the compression mechanism. After each of their functions is performed, the various movable mechanisms are repositioned for the next case being moved through the machine, allowing more than one case to be simultaneously processed by the machine.

In accordance with further aspects of this invention, preferably, the programmable controller is microprocessor based, i.e., formed of large-scale integrated (LSI) circuits. Also, preferably, the programmable controller is programmed by a control/display unit that includes a series of programming keys and an alphanumeric display. Further, preferably, the control/display unit includes a key-operated run-program switch whose state determines whether the controller is in a run mode of operation or a program mode of operation. Moreover, preferably, the control/display unit includes a modify-read switch whose state determines if the program can or cannot be modified during a pass through the program when the run-program switch is in the program state. Finally, preferably, the display displays only a minimal number of alphanumeric characters (e.g., four).

In accordance with still other aspects of this invention, the programmable controller is programmed to control various machine functions and, thus, the mode of operation of the programmable, random size case sealing machine. For example, either or both of the top and bottom glue heads can be inhibited from emitting glue. Thus, only the bottom of the case may be sealed, only the top of the case may be sealed, or both may be sealed, as desired. Further, the programming of the programmable controller controls the pattern of the glue emitted by the glue heads such that either a continuous or a stitch (e.g., intermittent) glue pattern occurs. In accordance with other aspects, the machine produces front and rear glue patterns, whose length is programmable. As a result, the amount of glue applied and, thus, the flap-sealing strength can be tailored to the ultimate use of the sealed cases. Further, glue application tailoring limits excessive glue use and spattering.

In accordance with still other aspects of this invention, in addition to controlling the glue heads in a programmable manner, the programmable controller also controls various other mechanisms so as to provide for random size case sealing. For example, the programmable controller controls the infeed alignment mechanism, which, preferably, is in the form of a pair of infeed rails. When the infeed rails impinge on the box, the closure of sensing switches controls a signal that causes a balancing of the position of the infeed rails (and, thus, the case) with respect to the center of the path of travel of the cases through the case sealing machine. After being balanced, inward movement of the infeed rails ends. The programmable controller also controls the raising and lowering of the kicker carriage and the compression carriage. Further, preferably, the programmable controller controls the inward movement of the top alignment mechanism mounted on the kicker carriage that, again, preferably, is in the form of a pair of (top) rails. When a sensing switch mounted on the top rails senses rail impingement on the case beneath the kicker carriage, the position of the top rails (and, thus, the case) is centered about the case path of travel. In addition, preferably, the programmable controller controls the actuation of the kicker and the discharge alignment mechanism. As with the infeed and top alignment mechanisms, preferably, the discharge alignment mechanism also comprises a pair of (discharge) rails. When a sensing switch mounted on one of the discharge rails senses case impingement, the position of the discharge rails (and, thus, the case) is centered beneath the compression carriage. Also, preferably, the rear case tracking mechanism is synchronized by a pulse produced by a synchronizing switch actuated when the case movement mechanism reaches a predetermined position; the front of case tracking mechanism is synchronized by a front of case sensing switch; the case movement mechanism is a chain-driven flight bar mechanism; and, the programmable controller controls the gate mechanism that allows random size cases to enter the case sealing machine of the invention.

As will be readily appreciated from the foregoing summary, the invention provides a programmable random size case sealing machine whose mode of operation can be readily changed. Further, because the controller is in the form of a control/display unit and a microprocessor, machine adjustments caused by controller changes due to mechanical wear are avoided. Because the mode of operation of a programmable random size case sealing machine formed in accordance with the invention can be rapidly changed by the control/display unit and because machine adjustments due to mechanical wear are avoided, machine down-time is low. Hence, the invention overcomes the disadvantages of prior art random size case sealing machines.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 11 is a flow diagram of a run subroutine suitable for inclusion in the overall sequence illustrated in FIG. 5;

FIG. 12 is a flow diagram of an open gate subroutine suitable for inclusion in the run subroutine illustrated in FIG. 11;

DESCRIPTION OF THE PREFERRED EMBODIMENT

Figure 1:
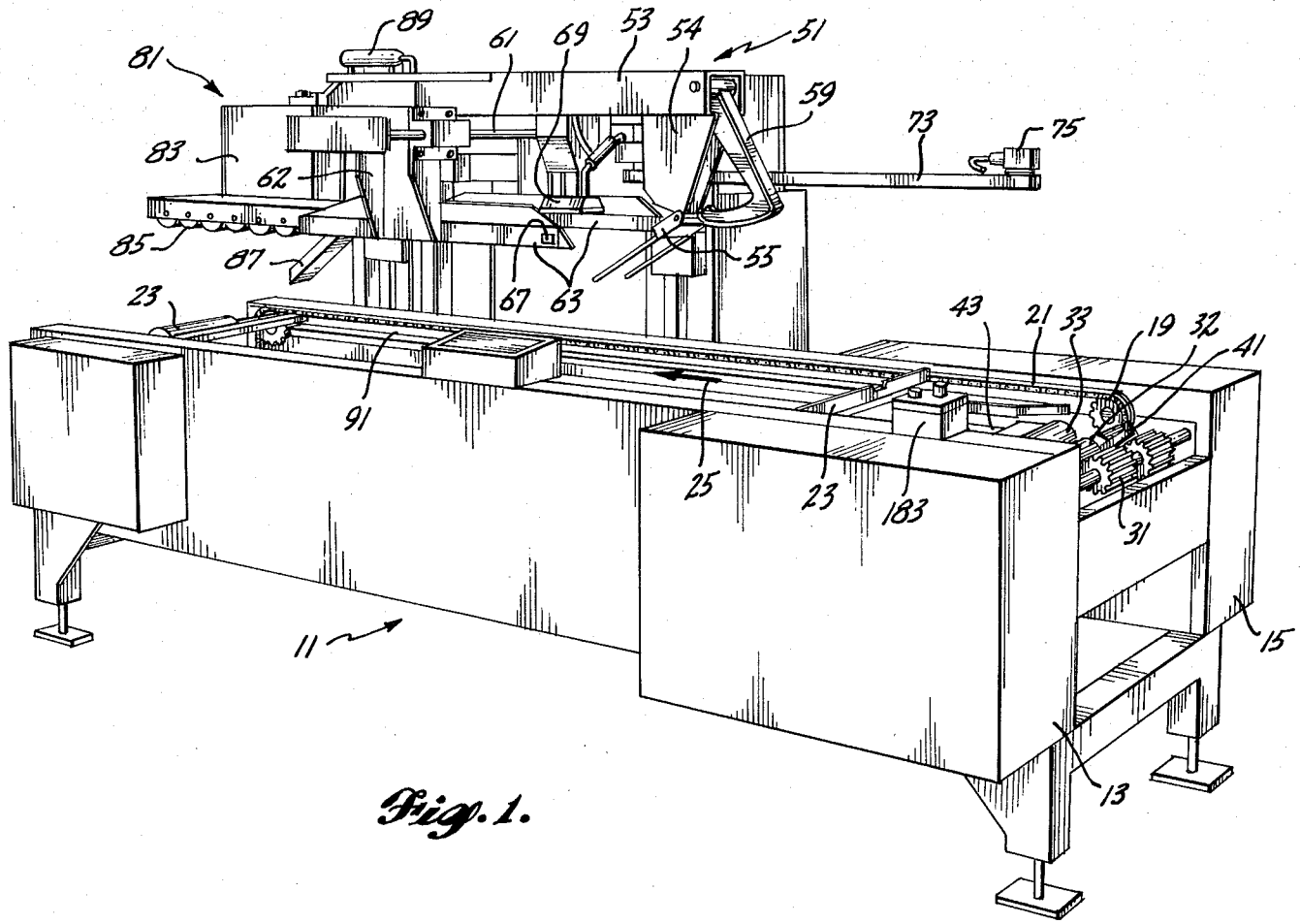
FIG. 1 is a pictorial view of the mechanical portion of a programmable random size case sealing machine formed in accordance with the invention.
Figure 2:
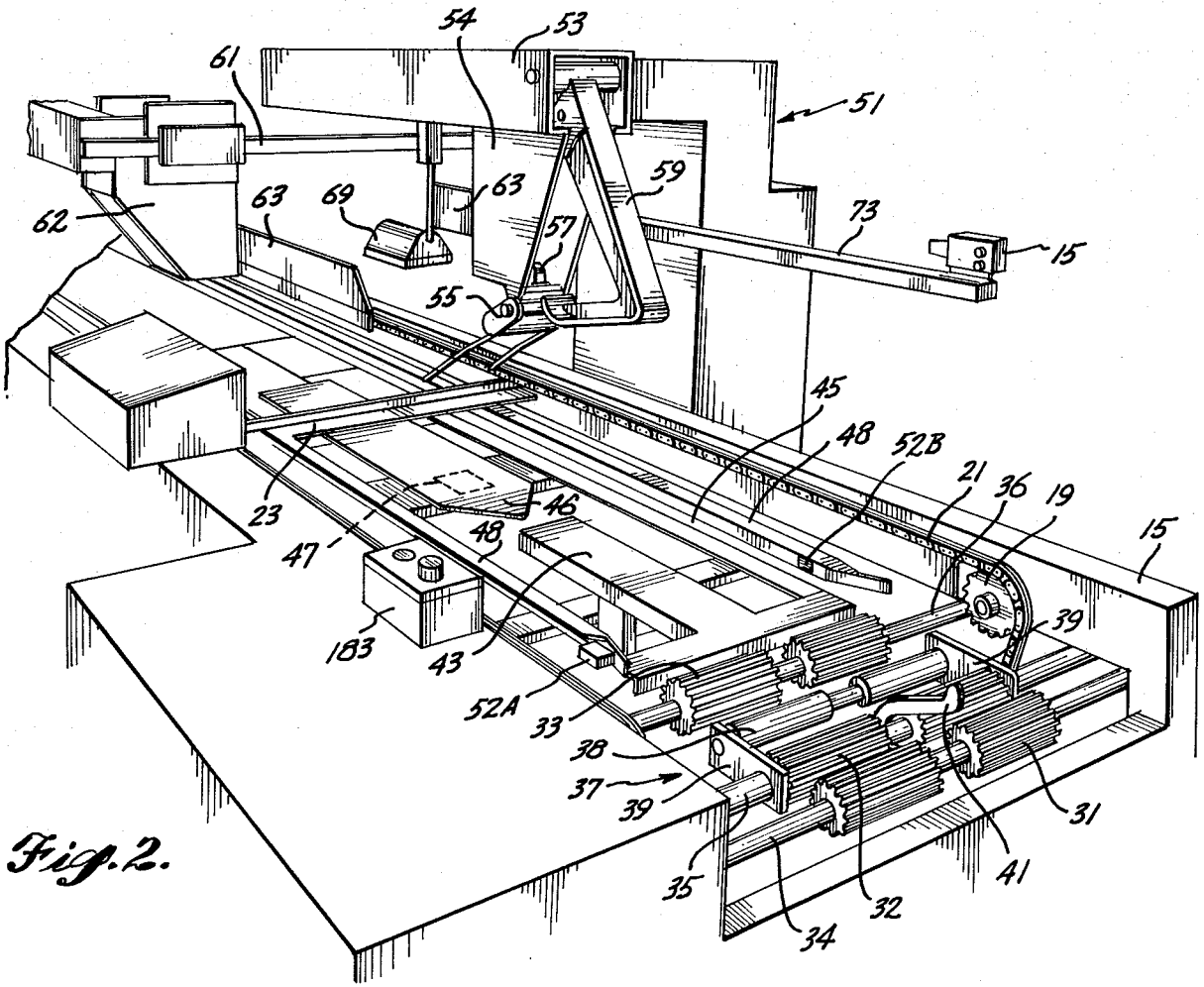
FIG. 2 is an enlarged pictorial view of a portion of FIG. 1.
Figure 3:
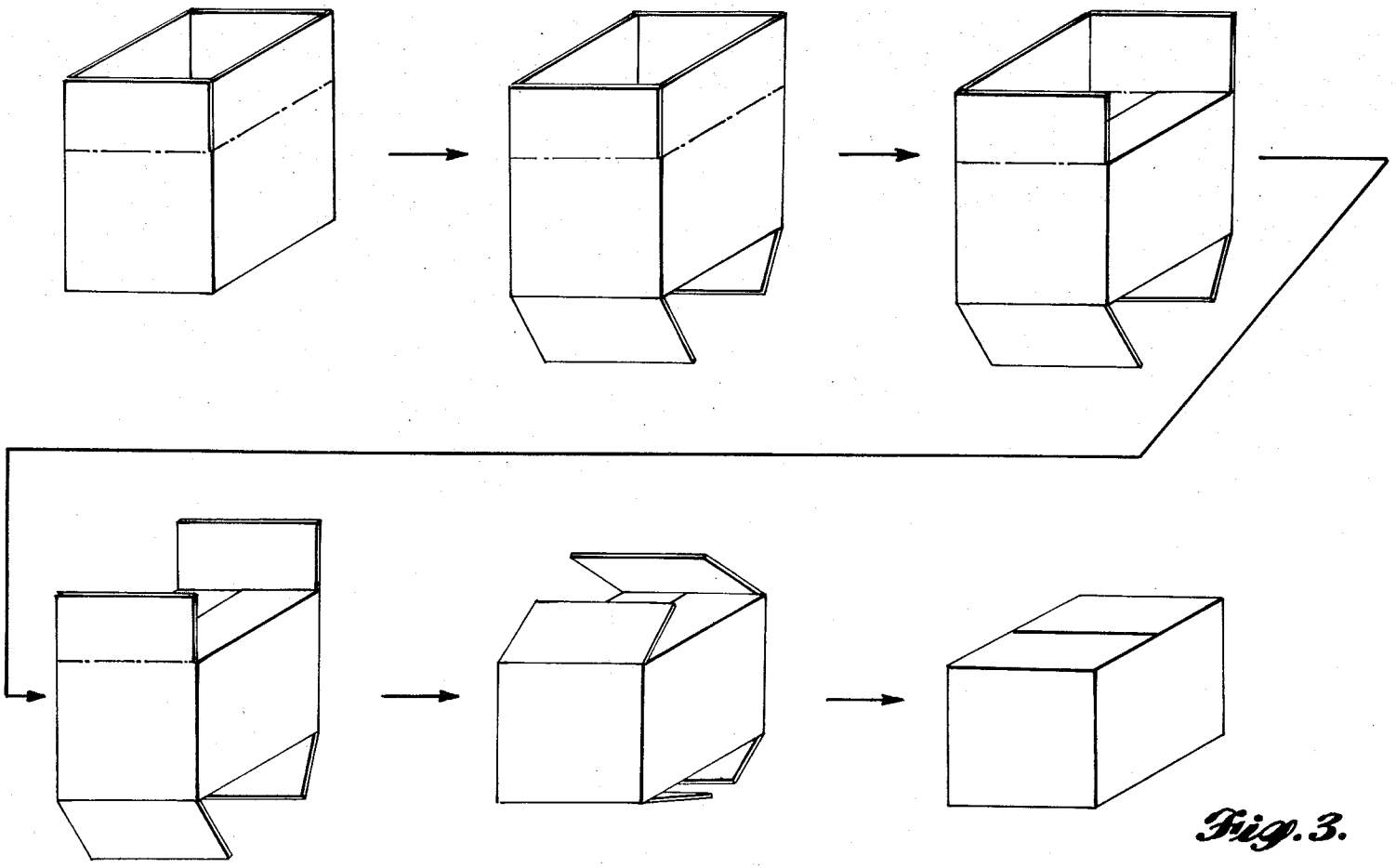
FIG. 3 is a pictorial diagram illustrating the sequence of positions of the top and bottom major and minor flaps of a case as it passes through a case sealing machine of the type illustrated in FIGS. 1 and 2 when both the top and bottom flaps of the case are to be sealed during a single pass through the machine.

FIGS. 1 and 2 illustrate the mechanical portion of the preferred embodiment of a programmable random size case sealing machine formed in accordance with the invention. Because the majority of the mechanisms illustrated in FIGS. 1 and 2 has been included in previously produced random size case sealing machines, they will not be described in detail. Rather, only the general layout of the major mechanisms will be described because such a description will make the overall nature and operation of the herein described programmable random size case sealing machine more easily understood.

The mechanical portion of the preferred embodiment of a programmable random size case sealing machine illustrated in FIG. 1 includes: a base 11 having a pair of parallel-oriented, vertical sidewalls 13 and 15. The inner faces of the sidewalls 13 and 15 each support a plurality of sprockets 19 that define mirror image paths of travel followed by a pair of chains 21, one of which is mounted on the sprockets 19 mounted on each of the sidewalls. The chains support a plurality of flight bars 23. More specifically, the flight bars 23 are attached to and extend between the sidewall-supported chains 21 so as to lie orthogonal to the vertical planes defined by the sidewalls. As a result, when the chains are moved by a flight bar motor 24 (FIG. 4), the flight bars are moved along the path of travel defined by the chains 21.

The path of travel defined by the chains 21 includes a relatively long upper run located near the upper edges of the sidewalls 13 and 15. When the flight bars move along this run, they push cases through the case sealing machine, as described in more detail below. An arrow 25 denotes the direction of case movement.

Located at the infeed end of the case sealing machine are three pairs of spaced-apart, power-driven rollers 31, 32 and 33. The pairs of rollers are mounted on three parallel oriented shafts 34, 35 and 36. The other surfaces of the pairs of power-driven rollers 31, 32 and 33 are longitudinally splined and the power rollers are oriented such that the axes of the shafts on which they are mounted lie transverse to the sidewalls 13 and 15. Thus, the axis of rotation of the pairs of power-driven rollers 31, 32 and 33 lies parallel to the longitudinal axis of the flight bars 23. The power-driven rollers are driven by suitable electric, pneumatic or hydraulic motor (not shown).

Located immediately downstream of two of the three pairs of power-driven rollers 31 and 32 is a gate 37 shown lowered in FIG. 2. The gate includes a pair of rollers 38. The pair of gate rollers 38 are elongate and are mounted on a common shaft whose axis lies parallel to the axes of the shafts on which the splined pairs of power-driven rollers 31, 32 and 33 are mounted. The shaft on which the gate rollers are mounted is, in turn, mounted on one end of a pair of plates 39. The other ends of the pair of plates 39 are mounted on the shaft 35 supporting the center pair of power-driven rollers 32. The plates 39 are located outside of the outer ends of the pair of power-driven rollers 32. The gate rollers 38 and the plates 39 form a gate that rotates about the shaft 35 on which the center pair of gate rollers 32 are mounted between an open position and a closed position.

Gate opening and closing is powered by a gate actuator 40 (FIG. 4) whose shaft is attached to the shaft on which the gate rollers 38 are mounted. When in the gate raised (e.g., closed) position, the gate rollers 38 lie above the center pair of power-driven rollers 32. When in the gate lowered (e.g., open) position, the gate rollers lie in the area between the center pair of power-driven rollers 32 and the downstream pair of power-driven rollers 33. When in the gate lowered position, the upper periphery of the gate rollers lies co-planar with the upper periphery of the three pairs of power-driven rollers. Thus, when lowered, a case is free to enter the random size case sealing machine herein described. When raised, the gate rollers prohibit such entry. Moreover, when in the raised position, the gate rollers open an aperture between the center pair of power-driven rollers 32 and the downstream pair of power-driven rollers 33. The flight bars 23 pass through this aperture just prior to entering the portion of the flight bar path of travel in which the flight bars push cases through the random size case sealing machine.

Cases are, of course, fed to the power-driven rollers by a suitable conveyor mechanism (not shown). As noted above, when raised, the gate rollers 38 prevent a case from entering the case sealing machine. As will be better understood from the following discussion, the gate rollers are lowered to allow case entry when a case is available and where the flight bar 23 that will push that case through the machine is in a predetermined position. When the gate rollers 38 are lowered, the case is moved into the machine by the pairs of power-driven rollers 31, 32 and 33. As this occurs, the case is partially supported by the lowered gate rollers 38. After the case entering the machine clears the gate rollers, the gate rollers 38 are raised to prevent the next case from entering the machine until the random size case sealing maching is ready for the next case.

Figure 4:
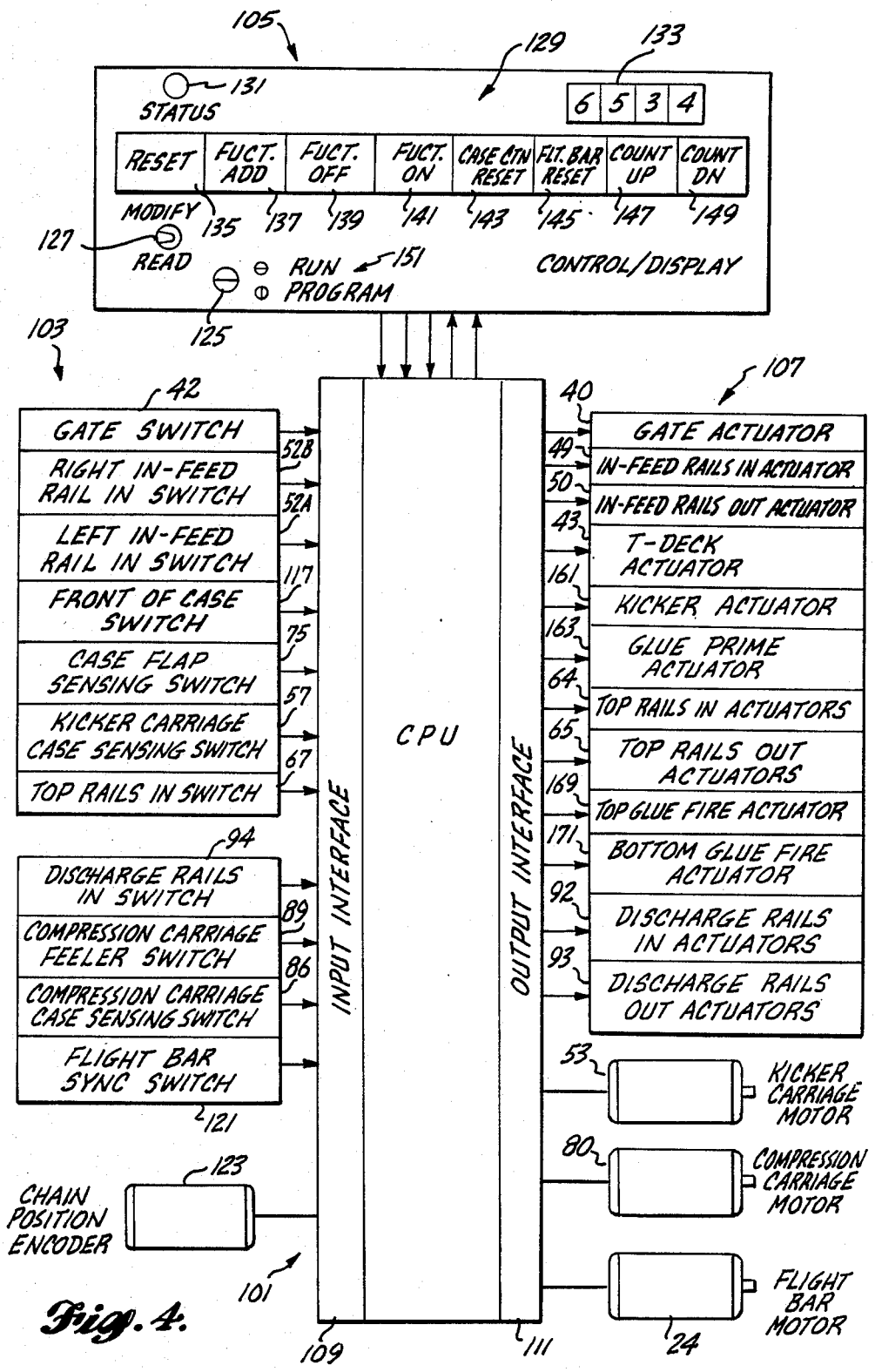
FIG. 4 is a block diagram illustrating the electrical portion of a programmable random size case sealing machine formed in accordance with the invention.

Located between the center pair of power-driven rollers 32 and the gate rollers 38 is a gate switch arm 41. The gate switch arm 41 is connected to a gate switch 42 (FIG. 4). The gate switch arm 41 is centered between the sidewalls 13 and 15. The gate switch arm 41 is spring loaded and oriented such that it projects above the first two pairs of power-driven rollers 31 and 32. When the gate switch arm is impinged on by a case stopped by the gate rollers 38, the gate switch arm 41 is pressed down into the space between the rollers of the first two pairs of power-driven rollers. When the gate switch arm 41 is pressed down in this manner, the gate switch 42 shifts from open to closed. The gate switch arm remains pressed down and, thus, the gate switch remains closed after the gate rollers are lowered, until the case clears the gate switch arm 41.

Located immediately upstream of the gate rollers 38 is the beginning of the long upper run of the path of travel of the flight bars 23. Located at the beginning of the long upper run, beneath the path of travel of the flight bars 23, is a T-deck. The T-deck includes a T-shaped support plate 43 that is vertically raised and lowered by a T-deck actuator 44. In the raised position, the T-shaped support plate lies co-planar with a pair of elongate case edge supports 45. The elongate case edge supports 45 lie on either side of the T-shaped support plate 43 and parallel to the path of travel of the flight bars 23. Thus, when the T-deck is raised, the leg of the T-shaped support plate provides support for the center of a case as it is moved through the random sized case sealing machine by the flight bars 23. In its lowered position the T-shaped support plate allows the center region of the bottom major flaps of a case supported by the elongate case edge supports 45 to drop. Of course, if the bottom flaps of the case are sealed, the bottom major flaps do not drop when the T-deck is lowered.

Located immediately upstream of the T-shaped support plate 42 is a plow 46. The plow houses a bottom glue head 47. The plow 46 and, thus, the bottom glue head 47 are centered along the path of travel followed by cases moved through the machine. As a result, when the T-deck is lowered and the bottom major flaps drop away from the bottom minor flaps, the plow 46 is aligned with the resulting separation region. As the case is thereafter moved toward the plow, the plow 46 enters the separation region. After such entry, the plow provides some support for the case. Further, since the bottom glue head is housed by the plow, the entry of the plow 45 in the separation region positions the bottom glue cead 47 such that it can apply glue to the bottom flaps when actuated to do so. If the bottom major flaps do not drop when the T-deck is lowered (because the bottom flaps were previously sealed), no separation region occurs. As a result, the plow 46 merely provides some support for the bottom of the case as such case is moved through the machine.

Located on either side of the T-deck, above the case edge supports 45 are a pair of infeed rails 48, one located on either side of the T-shaped support plate 42. The infeed rails 48 are moved inwardly and outwardly, i.e., toward and away from the T-deck, by infeed rails in and infeed rails out actuators 49 and 50 (FIG. 4). Located at the leading edge of the left infeed rail 48 is a left infeed rail in switch 52A and located near the leading edge of the right infeed rail 48 is a right infeed rail in switch 52B. The left and right infeed rail in switches 52A and 52B include switch arms that extend inwardly from the rails. When the switch arms impinge on a case located between the infeed rails with a suitable force, the left and right infeed rail in switches 52A and 52B are closed. The closing of the left and right infeed rail in switches 52A and 52B is sensed and the information used to balance the position of the infeed rails 48, as hereinafter described. As a result, a case moving through the random size case sealing machine is centered between rails, above the T-deck.

Located above the path of travel of cases moving through the random size case sealing machine, downstream of the T-deck, is a kicker carriage 51. The kicker carriage 51 is raised and lowered by a kicker carriage motor 53 (FIG. 4). Preferably, as shown in the drawings, the kicker carriage 51 is cantilevered over the case path of travel through the random size case sealing machine. The preferred mechanism for supporting and raising and lowering the kicker carriage is described in U.S. patent application Ser. No. 396,352 filed July 8, 1982 and entitled "Random Size Case Sealing Machine with Jack Screw Head-Positioning Mechanism." As required for an understanding of the present invention, the information contained in U.S. patent application Ser. No. 396,352 is incorporated herein by reference.

The kicker carriage 51 supports an elongate channel 53 centered above the path of travel of cases throgh the random size case sealing machine. Located on the upstream end of the channel 53 is a bracket 54. Hinged to the bottom end of the bracket 54 is a forked paddle 55 that includes a pair of tines that project downwardly and in the direction of case movement. The forked paddle 55 impinges on a kicker carriage case sensing switch 57 mounted in the bracket 54. When the forked paddle is raised with a sufficient force, due to impingement on the case, as hereinafter described, the kicker carriage case sensing switch 57 is closed.

In operation, as a case is moved beneath the kicker carriage 51, the kicker carriage is lowered. The leading minor flap of the moving case impinges on the tines of the forked paddle 55 folding this flap rearwardly and, at the same time, rotating the forked paddle upwardly, closing the kicker carriage case sensing switch 57. As a result of this switch closing, downward movement of the kicker carriage 51 is stopped. Thereafter a raised kicker (a generally U-shaped arm) 59 is lowered, which action "kicks" the trailing minor flap of the case forwardly.

Mounted on the elongate channel 53 forming part of the kicker carriage 51, upstream of the bracket 54, are a pair of support rods 61. The longitudinal axes of the support rods 61 lie orthogonal to the longitudinal axis of the elongate channel and, thus, orthogonal to the case path of travel. The support rods support a pair of top rail brackets 62, which, in turn, support a pair of top rails 63. The top rails 63 are moved inwardly and outwardly by top rail in and top rail out actuators 64 and 65 (FIG. 4). The top rails 63 are formed of sheet metal. The sheet metal rails are elongate and include vertical and upper, inwardly projecting regions. An obtuse angle is defined by the vertical and the upper, inwardly projecting sheet metal regions. Located near the leading edge of the vertical region of one of the sheet metal top rails 63 is a top rails in switch 67. The top rails in switch 67 includes a switch arm that impinges on and closes the top rails in switch when the switch arm impinges on a case (located between the top rails 63) with a sufficient amount of force.

In operation, when the top rails 63 are moved inwardly toward a case located beneath the kicker carriage, the switch arm impinges on the adjacent side of the case. When the switch arm impinges on the case with a sufficient amount of force, the top rails in switch closes. When the top rails in switch closes, the controller, as will be better understood from the following description, balances the force applied to the actuators that moves top rails. As a result, a case located beneath the kicker carriage is maintained centered along the case path of travel. Further, the top major flaps, located along the side of the case being sealed, are folded inwardly, i.e., toward one another by the upper inwardly projecting regions of the sheet metal forming the top rails 63. While folded inwardly, the top major flaps are not yet flattened against the top minor flaps.

Also mounted on the channel 53 is a top glue head 69. The top glue head is positioned to pass through the region lying between the inwardly folded top major flaps and the downwardly folded top minor flaps as a case is moved beneath the kicker carriage 51. As a result, the top glue head 69 is positioned to apply glue to the region between the top major and minor flaps (if actuated to do so) as a case is moved beneath the kicker carriage 51.

Mounted on the kicker carriage 51 is an arm 73. The arm 73 lies along one side of the case path of travel and extends upstream of the kicker carriage, i.e., toward the gate of the machine. The arm 73 lies well above the infeed rail located on the related side of the case path of travel. A case flap sensing switch 75 is mounted on the upstream end of the arm 73. Preferably, the case flap sensing switch 75 is a photoelectric switch that includes a light emitting device, such as a light emitting diode (LED), and a light sensing device, such as a phototransistor. The case flap sensing switch is positioned such that light emitted by the light emitting device impinges on the adjacent top major flap of a case entering the random size case sealing machine if the switch is not above the flap. The impinging light is reflected to the light sensing device. If the switch is above the flap, no such reflection occurs. Thus, the case flap sensing switch provides information about the height of the kicker carriage with respect to an incoming case. The controller uses this information to raise the kicker carriage to avoid interference between the kicker carriage and the incoming case.

Located downstream of the kicker carriage 51 is a compression carriage 81. The compression carriage 81 is raised and lowered by a suitable raising and lowering mechanism, also preferably of the type described in U.S. patent application Ser. No. 396,352 referenced above, which mechansim includes a compression carriage motor 80 (FIG. 4). The compression carriage 81 supports a bracket 83 that, in turn, supports a plurality of compression rollers 85. The compression rollers are aligned with the center of the path of travel of a case through the random size case sealing machine. Located upstream of the rollers 85 is an arm 87 that impinges on a compression carriage case sensing switch 86 (FIG. 4).

As a case moves from beneath the kicker carriage 51, it begins a pass beneath the compression carriage 81. As the pass begins, the compression carriage 81 is lowered. As the compression carriage 81 is lowered, the arm 87 is raised due to impingement on the case. As the arm 87 is raised, it reaches a position whereat the force applied to the arm closes the compression carriage case sensing switch 86. When this occurs downward movement of the compression carriage 81 ends. When downward movement ends, the position of the compression carriage rollers 85 is such that they impinge on the top major flaps of the case passing beneath the compression carriage. The impingement finishes the folding of the top major flaps and creates a vertical force that presses the top major flaps against the top minor flaps, causing the flaps to adhere to one another. Simultaneously, the dropped bottom major flaps (if the bottom of the case is to also be sealed) are deflected upwardly and the same vertical force presses the bottom major flaps against the bottom minor flaps, causing those flaps to also adhere to one another.

Mounted atop the downstream end of the elongate channel 53 forming part of the kicker carriage 51 is a compression carriage feeler switch 89. The compression carriage feeler switch 89 is operated by a spring loaded line whose outer end is attached to the compression carriage 81. When the amount of line extended due to an elevational separation between the kicker and compression carriages exceeds a predetermined level, the compression carriage feeler switch is closed. The closure is sensed and the information used in the manner hereinafter described to limit the amount of elevational separation between the kicker and compression carriages.

Finally, located beneath the compression carriage 81 are a pair of discharge rails 91. The discharge rails 91 are movable inwardly and outwardly by discharge rails in and discharge rails out actuators 92 and 93 (FIG. 4). Located on the upstream end of one of the discharge rails is a discharge rails in switch 94. As a case enters the region beneath the compression carriage 81, the discharge rails 91 are moved inwardly. When the rail supporting the discharge rails in switch 94 reach a position such that the force applied to an arm forming part of the switch closes the discharge rails in switch, the force applied to the discharge rails is balanced. As a result of the balancing (e.g., centering) of the discharge rails with respect to the case path of travel, a case passing beneath the compression carriage 81 is maintained centered beneath the compression rollers 85. After passing beneath the compression carriage 81, cases are discharged from the random size case sealing machine to a suitable receiving mechanism, such as a conveyor.

FIG. 4 is a block diagram of the electrical portion of a programmable random size case sealing machine formed in accordance with the invention and comprises: a central processing unit (CPU) 101; a plurality of input sensors 103; a control/display unit 105; and, a plurality of control devices 107. In addition to a microprocessor, and suitable memory and other required devices, the CPU also includes an input interface 109 and an output interface 111.

The input sensors 103 include the various switches described above—the gate switch 42; the left and right infeed rails in switches 52A and 52B; the kicker carriage case sensing switch 57; the top rails in switch 67; the case flap sensing switch 75; the compression carriage case sensing switch 86; the compression carriage feeler switch 89; and, the discharge rails in switch 94. Preferably, all of these switches, except for the case flap sensing switch, are mechanical sensing switches even through they could take other forms. As previously described, preferably, the case flap sensing switch is a photoelectric sensing switch. In addition to the switches just described, the input sensors 103 also include: a front of case sensing switch 117; and, a flight bar sync switch 121. The front of case sensing switch 117 is a feeler switch positioned along the path of travel of a case through the random size case sealing machine that is closed when the leading edge of a case reaches a predetermined position. The front case switch remains closed during the entire period of time a case is passing the switch. The flight bar sync switch is a sync switch, preferably mechanically actuated by the flight bars each time one of the flight bars reaches a predetermined position along the flight bar path of travel.

In addition to receiving information from the various switches just described, the input interface also receives pulses from a chain position encoder 123. The chain position encoder is driven by the chain forming part of the flight bar movement mechanism. For each predetermined increment of chain movement the chain position encoder produces a pulse. The pulses are received by the input interface 109 and used by the CPU in the manner hereinafter described.

The control/display unit 105 provides an operator interface with the CPU 101. The control/display unit includes a run-program switch 125; a read-modify switch 127; a plurality of program keys 129; a status light 131; and, an alphanumeric display 133. The program keys 129 include: a reset key 135; a function-address key 137; a function off key 139; a function on key 141; a case count reset key 143; a flight bar reset key 145; a count-up key 147; and, a countdown key 149. The run-program switch 125 is, preferably, a two-position key-operated switch—the two positions are denoted the run position and the program position. When in the run position, the run-program switch 125 places the case sealing machine in a run mode of operation. In the program position, the run-program switch places the machine in a program mode of operation. Preferably, a run-program switch display 151 is provided to show the key positions for the two modes of operation. The use of a key switch has the advantage of preventing unauthorized or inadvertent reprogramming of the random size programmable case sealing machine. Preferably, the read-modify switch 127 is a two-position toggle switch that can be placed in either a read or a modify position. Preferably, the program keys 129 are momentary contact panel switches of the type utilized in a wide variety of electronic devices, such as calculators, keyboards, etc. The status light 131 is, preferably, a light-emitting diode (LED) covered with a suitably colored lens, e.g., a red lens. Preferably, the alphanumeric display 133 is a four-character display suitable for displaying either letters or numbers, as desired.

The devices 107 controlled by the CPU 71 include: the gate actuator 40; the T-deck actuator 43; the infeed rails in actuators 49; the infeed rails out actuators 50; the top rails in actuators 64; the top rails out actuators 65; the discharge rails in actuators 92; and, the discharge rails out actuators 93. The devices controlled by the CPU also include: a kicker actuator 161; a glue prime actuator 163; a top glue fire actuator 169; and, a bottom glue fire actuator 171. Preferably, all of the actuators are pneumatic actuators suitable for performing the described functions that they perform, most of which have been described above. With regard to those not discussed, the kicker actuator 161 actuates the kicker 59. The glue prime actuator 163 is an actuator for a glue prime pump required for certain types of glue heads. The glue prime pump pressures the glue heads prior to their being actuated to emit glue. The top and bottom glue fire actuators 169 and 171, upon receipt of a suitable actuation signal from the CPU, cause the top and bottom glue heads 69 and 71 to emit glue. While the various actuators are, preferably, pneumatic, it is to be understood that in certain circumstances, any or all of the actuators could take other forms, such as electric or hydraulic, if desired.

In addition to the various actuators described above, the CPU via the output interface 111 also controls: the bidirectional kicker carriage motor 53, which raises and lowers the kicker carriage 51; the bidirectional compression carriage motor 80, which raises and lowers the compression carriage 81; and, the flight bar motor 20, which is coupled to the chain of the flight bar mechanism and, thus, moves the flight bars. Preferably, the kicker carriage, compression carriage, and flight bar motors are electric, even though they may take the form of hydraulic or air-operated motors, if desired.

As will be readily appreciated from the foregoing description, the electrical portion (FIG. 4) of the preferred embodiment of a random size programmable case sealing machine formed in accordance with the invention includes several sensors plus a chain position encoder. The information produced by the sensors in combination with the way the CPU is both preprogrammed and programmed by an operator via the control/display unit controls the sequence of operations of the mechanical portion (FIGS. 1 and 2) of the preferred embodiment. Various sequences of operation are possible depending upon whether the bottom, top, or both flaps of a case entering the machine are to be sealed. The CPU makes continual passes through a program with the branches followed during any pass being determined by various factors, primarily how the CPU is programmed and the position of cases in the machine at the time the pass is made. The various paths or sequences of operation are illustrated in flow diagram form in FIGS. 5 through 22 and next described.

Figure 5:
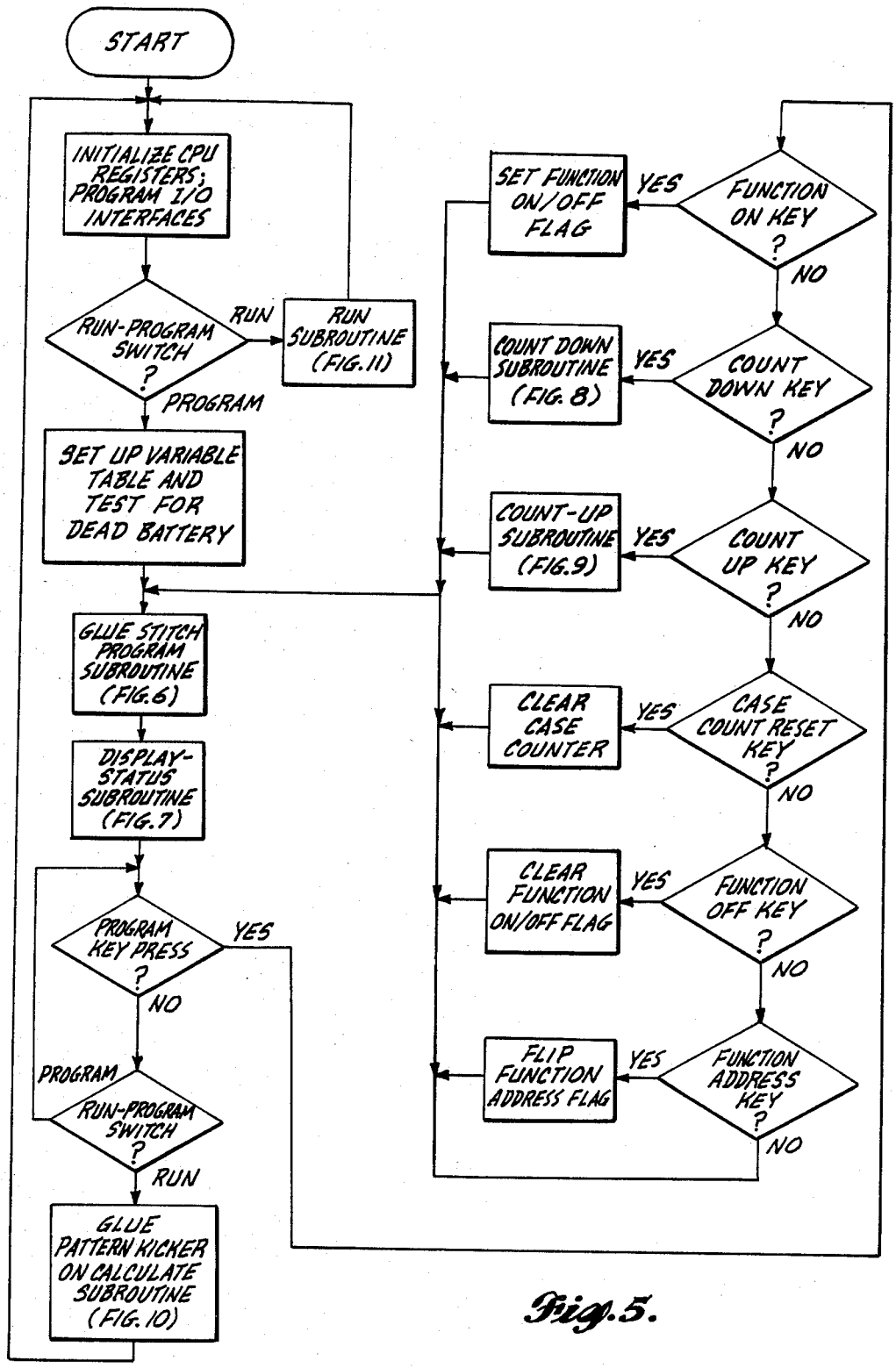
FIG. 5 is a flow diagram illustrating the overall sequence of operation of the central processing unit (CPU) illustrated in FIG. 4.

FIG. 5 is a flow diagram illustrating the overall sequence of operation of the CPU for a preferred embodiment of a random size programmable case sealing machine formed in accordance with the invention. When power is applied to the machine or a power reset control switch 183 (FIG. 1) is actuated, the sequence illustrated in FIG. 5 begins. The first step is to initialize the CPU registers and program the input and output (I/O) interfaces 109 and 111 (FIG. 4). The interface programming involves setting, (e.g., programming) two input-/output circuits such that one functions as an input interface and the other functions as an output interface. In addition to programming the circuits such that one circuit functions as an input interface and the other as an output interface, the circuits are programmed to produce and acknowledge interrupts and function in other manners well known to those skilled in the microprocessor art.

After the input and output interfaces have been programmed, a test is made to determine the status of the run-program switch. If the run-program switch 125 is in the run position, a run subroutine (illustrated in FIGS. 11–21 and described below) is entered. If the run-program switch 125 is in the program position, a variable table is set up and a test is made to determine if a battery used to refresh memory information in a temporary memory, such a random access memory (RAM), is dead. The variable table is stored in the RAM. The table includes a section for each of the variable functions that can be programmed—rear glue pattern length; and, kicker actuation position. Preferably, the first byte of each section identifies the function, the next byte (or bytes) identifies the maximum value of the function (read from permanent memory) and the remaining byte (or bytes) stores the function value programmed by the operator in the manner hereinafter described.

Figure 6:
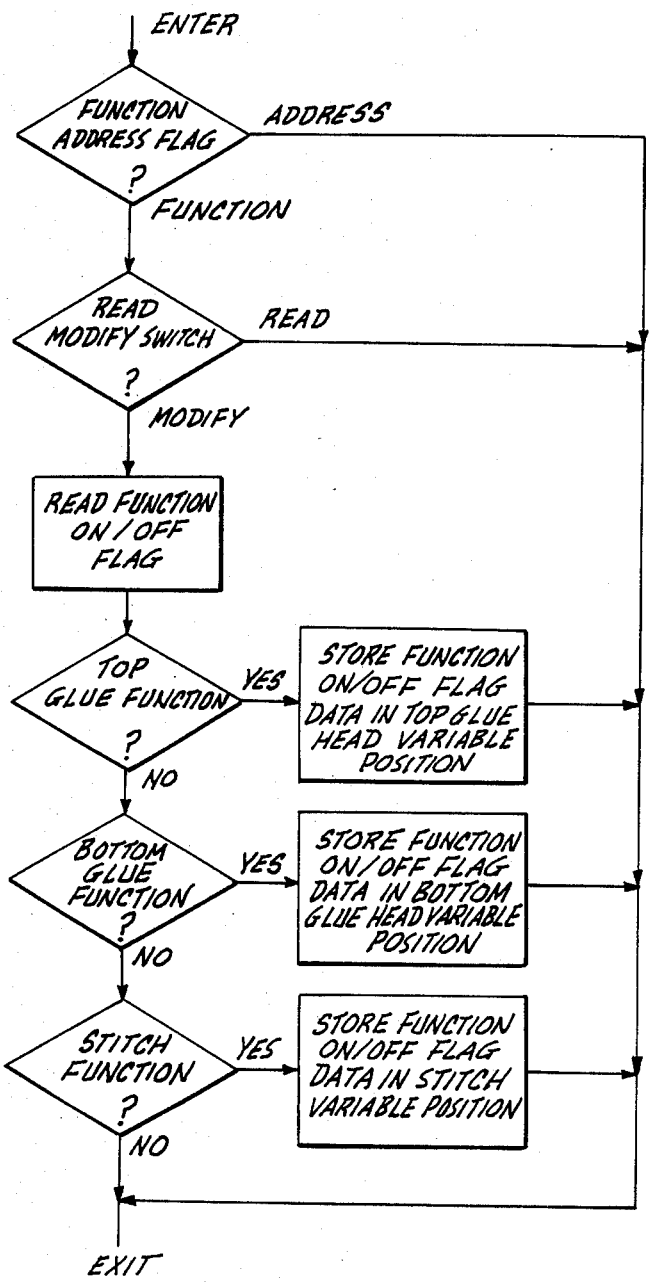
FIG. 6 is a flow diagram of a glue-stitch subroutine suitable for inclusion in the overall sequence illustrated in FIG. 5.

After the variable table has been set up and the dead battery test performed, the glue-stitch program subroutine illustrated in FIG. 6 is entered. The first step in the glue-stitch program subroutine is a test to determine the status of the function-address flag toggled by the function-address key 137 (FIG. 4) in the manner hereinafter described. If the function-address flag is in the address state, the remaining steps of the glue-stitch program subroutine are bypassed and the sequence of operation of the programmable random size case sealing machine cycles to the display-status subroutine illustrated in FIG. 7 and described below. If the function-address flag is in the function state a test of the read-modify switch 127 is made. If the read-modify switch is in the read state, the remaining steps of the glue-stitch program subroutine are again bypassed and the sequence of operation cycles to the display-status subroutine. If the read-modify switch 127 is in the modify state, the status of a function on/off flag programmed in the manner hereinafter described is read. Then a test is made to determine if the particular function being modified is the top glue function. This test is made by reading the status of a function counter that is incremented and decremented in the manner hereinafter described. If the counter is set to a value that identifies the top glue function, the top glue function test is positive and the status of the function on/off flag is stored in the top glue head variable position of the RAM. More specifically, the RAM includes a position (memory bin) that stores a bit of information that is used to control the actuation of the top and bottom glue heads as a case passes the top and bottom glue heads 69 and 71. A RAM position is provided for each of the glue heads. Thus, each glue head is separately programmed. If the bit stored in the RAM position is high, glue will be applied and if the bit is low, glue will not be applied. The glue head bits are programmed by setting (or clearing) the function on/off flag in the manner described below and, then, later reading and storing the set (high) or clear (low) value in the glue variable RAM position during a pass through the glue-stitch program subroutine in the manner just described. After the state of the function on/off flag has been stored in top glue head variable position in the RAM, the sequence of operation cycles to the display-status subroutine.

If the top glue function is not being modified, a test is made to determine if the bottom glue function is being modified. Again, this test is made by reading the status of a hereinafter described function counter. If the bottom glue function test is positive, the status of the function on/off flag is stored in the bottom glue head variable position in the RAM.

Figure 7:
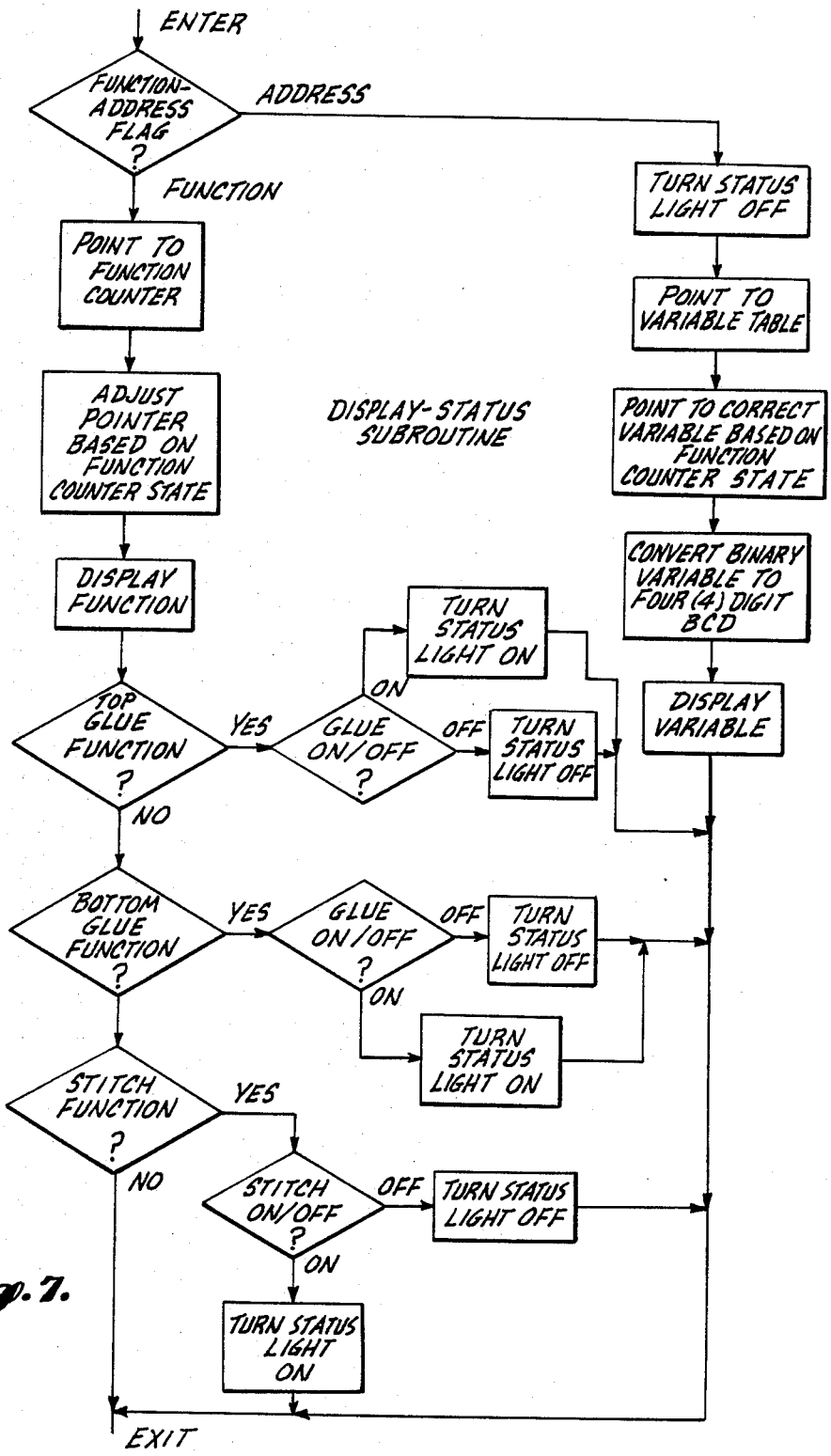
FIG. 7 is a flow diagram of a display-status subroutine suitable for inclusion in the overall sequence illustrated in FIG. 5.

If the function counter value was not set at a glue function, a test is made to determine if the fucntion counter is set at a value that identifies the stitch function. If the function counter value is the stitch function, the state of the function on/off flag is read and stored in a stitch variable position in the RAM in the same manner as the state of the function on/off flag is stored in the top and bottom glue head variable positions in the RAM. Thereafter, the sequence of operation cycles to display-status subroutine. If the function counter is not set at the stitch function, the sequence of operation also cycles to the display-status subroutine. After a pass through the glue-stitch subroutine (following one of the paths just described) is completed, the display-status subroutine illustrated in FIG. 7 is entered.

The first step in the display-status subroutine is a test of the status of the function-address flag. If the function-address flag is in the function state, the program "points" to the function counter. As noted above, the state of the function counter relates to the programmable machine function. In the preferred embodiment of the random size programmable case sealing machine hereinafter described, there are five programmable functions, all of which have been referred to above. They are the top glue function, the bottom glue function, the stitch function, the glue pattern length function and the kicker down position function. The first three functions (e.g., the top and bottom glue and stitch functions) are on/off functions. The latter two functions (e.g., the glue pattern length function and the kicker down position function) are numerical value functions. In any event, because there are five programmable functions, the function counter can be set to any one of five possible numerical states—0, 1, 2, 3 and 4.

After the program "points" to the function counter, the program "points" to a display bin in permanent memory based on the state of the function counter. The permanent memory, which may be in the form of a ROM or a variation thereof, such as a programmable read-only memory (PROM) or an erasable programmable read-only memory (EPROM), stores in the pointed to bin data suitable for creating a display of the function defined by the function counter value, such as TGLU to denote the top glue head function; BGLU to denote the bottom glue head function; STCH to denote the stitch function; PATL to denote the glue pattern length function; and, KICK to denote the kicker down position function. The pointed to function is then displayed.

After the command to display the pointed to function has occurred, a test is made to determine if the function is the top glue function. If the function is the top glue function, a test is made of the top glue head variable position in the RAM to determine if the top glue function is programmed on or off. If the top glue function is programmed off, the status light 131 is turned off (or commanded to remain off if it was off). Thereafter, the program leaves the display-status subroutine and cycles to a program key press test in the overall sequence illustrated in FIG. 5 and described below. Contrariwise, if the top glue function is programmed on, the status light is turned on (or commanded to remain on), and, then, the display-status subroutine ends and the sequence of operation cycles to the hereinafter described program key press test.

If the top glue function test is negative, a test is made to determine if the function is the bottom glue function. If the function is the bottom glue function, a test is made of the bottom glue head variable position in the RAM to determine if the bottom glue function is programmed on or off. If the bottom glue function is programmed off, the status light 131 is turned off (or commanded to remain off if it was off). Thereafter, the program leaves the display-status subroutine and cycles to a program key press test in the overall sequence illustrated in FIG. 5 and described below. Contrariwise, if the bottom glue function is programmed on, the status light is turned on (or commanded to remain on) and, then, the display-status subroutine ends and the sequence of operation cycles to the hereinafter described program key press test.

If the glue function test is negative, a test is made to detemrine if the displayed function is the stitch function. If the displayed function is the stitch function, a test is made of the stitch variable position in the RAM to determine if the stitch function is programmed on or off. If the stitch function is programmed off, the status light is turned off (or commanded to remain off) and the sequence of operation cycles to the point in the overall sequence illustrated in FIG. 5 where the program key press test occurs. If the stitch function is programmed on, the status light is turned on (or commanded to remain on) and, then, the sequence of operation cycles to the key press test. Finally, if the stitch function test is negative, the display-status subroutine ends and the sequence of operation cycles to the program key press test.

If the function-address flag test that occurs when the display-status subroutine is entered determines that the function-address flag is in the address state, the path illustrated on the right side of FIG. 7 is followed. The first step in this path is to turn off the status light (or command the status light to remain off). The status light is turned off becaues the status light state is related only to the stitch and top and bottom glue head functions and the information to be displayed when the right path is followed relates to the functions programmed with numerical values—the glue pattern length function and the kicker down position function. After the status light is turned off, the program points to the variable table (as noted above, the variable table contains the programmed numerical data for the glue pattern length and the kicker down position functions). Thereafter, the program adjusts the pointer to point to the correct variable based on the function counter value. That is, if the function counter is set at the glue pattern length value, the glue pattern length variable is pointed to. Contrariwise, if the function counter is set at the kicker down position value, the kicker down position variable is pointed to. Then, the programmed value of the "pointed to" variable is read out and converted from pure binary form to four (4) digit binary coded decimal (BCD) form. The BCD value is then used to create a decimal display of the programmed value of the "pointed to" variable. As described below, the programmed values are changed, i.e., incremented and decremented, during passes through the countdown and count-up subroutines illustrated in FIGS. 8 and 9. After the programmed value has been displayed, the display-status subroutine terminates and the sequence of operation cycles to the point in the overall sequence illustrated in FIG. 5 where the program key press test takes place.

After a pass through the display-status subroutine (FIG. 7) has occurred, as illustrated in FIG. 5, the program key press test is made. The program key press test is a test of all of the program keys 129 to determine if any key is being actuated (e.g., pressed). If a program key is being pressed, sequential tests are made to determine which one of certain ones of the program keys is being pressed. If one of the tested keys is pressed, the action commanded by the pressed or actuated key occurs. The key tests and actions that occur are illustrated on the right side of FIG. 5 and next described.

First, a test is made to determine if the function on key is being pressed. If the function on key is being pressed, the function on/off flag is set. Thereafter, the overall sequence cycles to the point where the glue-stitch program subroutine is entered. If the function on key is not being pressed, a test is made to determine if the countdown key is being pressed. If the countdown key is being pressed, the countdown subroutine illustrated in FIG. 8 is entered.

Figure 8:
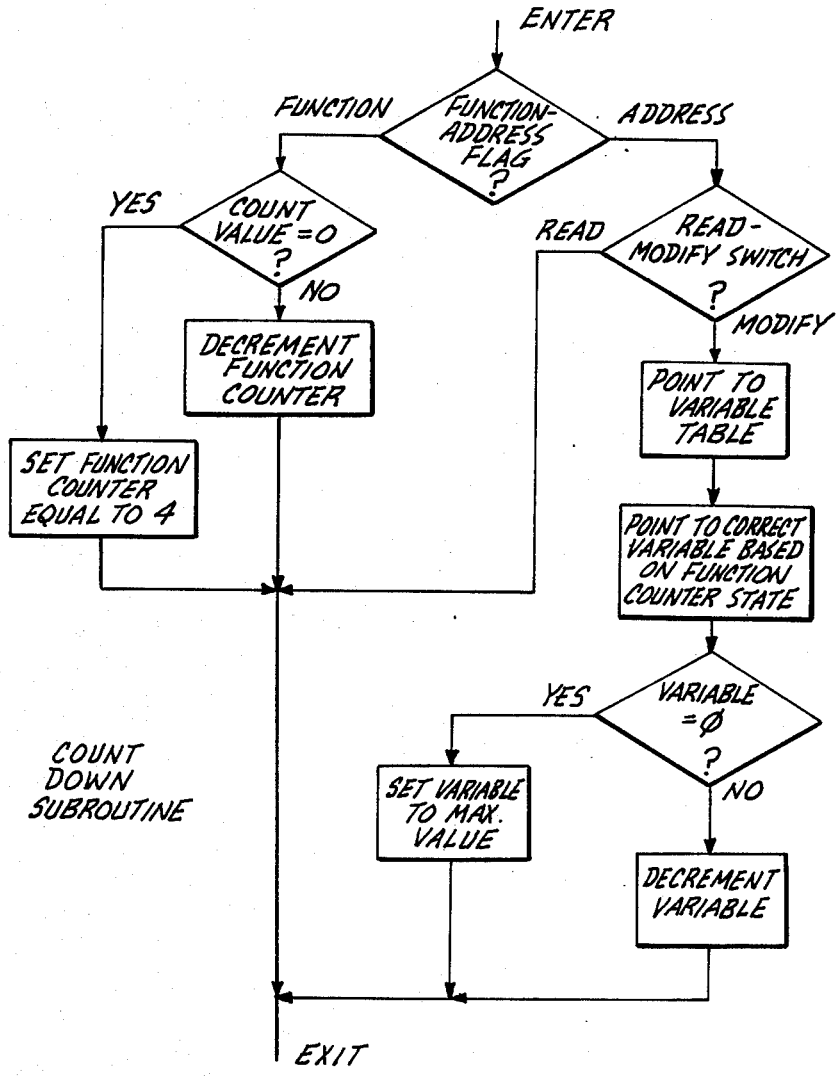
FIG. 8 is a flow diagram of a countdown subroutine suitable for inclusion in the overall sequence illustrated in FIG. 5.
Figure 9:
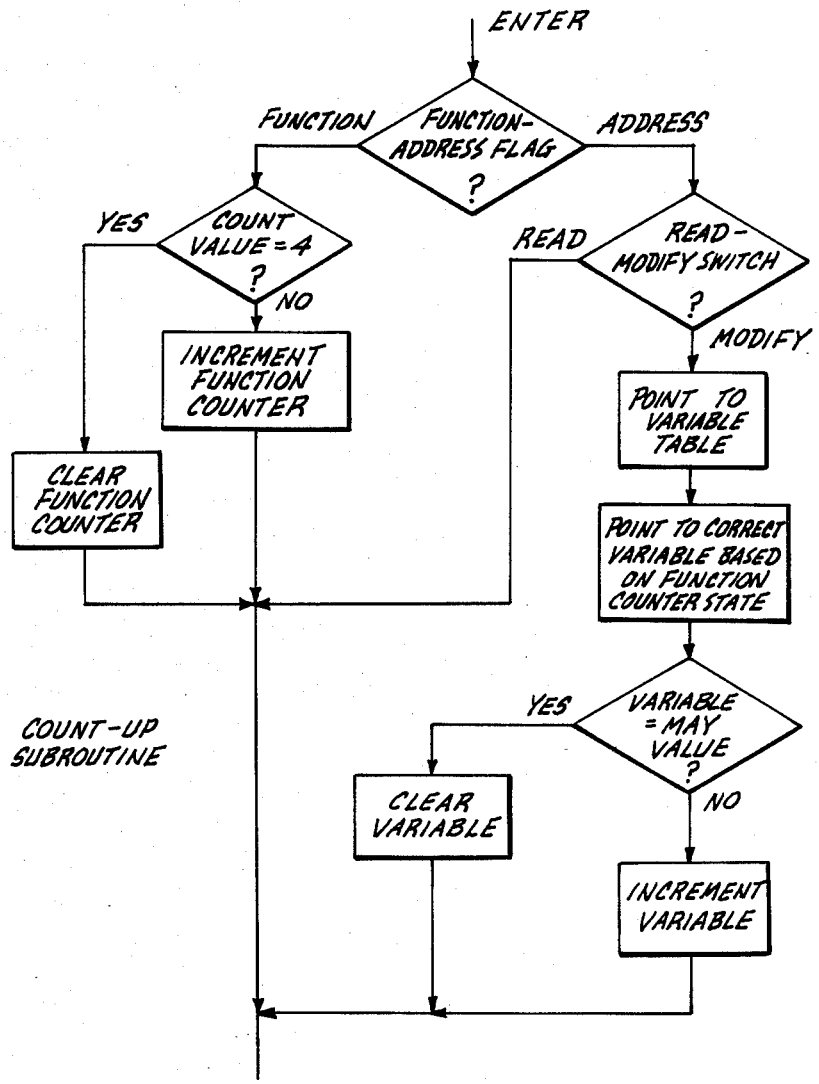
FIG. 9 is a flow diagram of a count-up subroutine suitable for inclusion in the overall sequence illustrated in FIG. 5.

The first step in the countdown subroutine illustrated in FIG. 8 is a test of the function-address flag. If the function-address flag is in the function state, a test is made to determine if the count value of the function counter is equal to zero. If the count value of the function counter is not equal to zero, the function counter is decremented. Thereafter, the countdown subroutine terminates and the sequence of operation cycles to the point where the glue-stitch subroutine is entered, as illustrated in FIG. 5. If the status of the function counter is equal to zero, the function counter is set equal to its maximum value—four (4). As noted above, the function counter maximum numerical value is four because the herein described embodiment of a programmable random size case sealing machine formed in accordance with the invention has five functions. Thereafter, the countdown subroutine ends and the sequence of operation cycles to the point in the overall sequence where the glue-stitch program subroutine is entered.

If the function address flag is in the address state when the countdown subroutine is entered, the state of the read-modify switch is tested. If the read-modify switch is in the read position, the countdown subroutine ends and the sequence of operation cycles to the point in the overall sequence (FIG. 5) where the glue-stitch program subroutine is entered. If the read-modify switch is in the modify position, the program "points" to the variable table. Thereafter, the program "points" to the correct variable based on the status of the function counter. Then, the programmed value of the variable is tested to determine if it is equal to zero. If the programmed value of the "pointed to" variable is not equal to zero, the programmed value is decremented and the result becomes a new programmed value for the "pointed to" variable. If the program value is equal to zero, the program value is set equal to the maximum value, which was read from permanent memory and stored in the variable table when the table was set up, as previously described. Thereafter, the countdown subroutine ends and the sequence of operation cycles to the point in the overall sequence where the glue-stitch program subroutine is entered.

If the countdown key is not being pressed when the countdown key test takes place, then, as shown in FIG. 5, a test of the count-up key is made to determine if the count-up key is being pressed. If the count-up key is being pressed, a count-up subroutine (illustrated in FIG. 9) is entered.

The first step in the count-up subroutine is a test of the function-address flag. If the function-address flag is in the function state, the function counter is tested to determine if its value is equal to four (4). If equal to four (4), the function counter is cleared, i.e., set equal to zero (0). If not equal to four, the function counter is incremented. After the function counter has been tested and changed, the count-up subroutine ends and the sequence of operation cycles to the point in the overall sequence (FIG. 5) where the glue-stitch program subroutine is entered.

If the function-address flag is the address state when the count-up subroutine is entered, the read-modify switch is tested. If the read-modify switch is in the read position, the count-up subroutine ends and the sequence of operation cycles to the glue-stitch program subroutine. If the read-modify switch is in the modify position, the program "points to" the variable table, and then, to the correct variable based on the state of the function counter. If the function counter state is the glue pattern length state, the glue pattern length variable is pointed to. Contrariwise, if the function counter is in the kicker down position state, the kicker down position variable is pointed to. (The top and bottom glue head and stitch function counter states point to no variables since none exist.) After the correct variable is pointed to, the programmed value for the variable is tested to determine if it is equal to the maximum value for the pointed to variable. If the programmed value is equal to the maximum value, the programmed value is cleared, i.e., set equal to zero (0). Alternatively, if the programmed value is not equal to the maximum value, the programmed value is incremented. The incremented value then forms a new programmed value. After the programmed value has been changed, the count-up subroutine ends and the sequence of operation cycles to the point in the overall sequence where the glue-stitch program subroutine is entered, as illustrated in FIG. 5.

If the count-up key test determines that the count-up key 147 is not being pressed, a test is made to determine if the case count reset key 143 is being pressed. If the case count reset key is being pressed, a case counter (which is incremented each time a case is sealed when the machine is in the run mode of operation, as hereinafter described) is cleared. After the case counter is cleared, the sequence of operation cycles to the point where the glue-stitch program subroutine is entered.

If the case count reset key is not being pressed, a test is made to determine if the function off key 139 is being pressed. If the function off key is being pressed, the function on/off flag is cleared and the sequence of operation cycles to the point where the glue-stitch subroutine is entered, as illustrated in FIG. 5. If the function off key is not being pressed, a test is made to determine if the function-address key 137 is being pressed. If the function-address key is being pressed, the function-address flag is toggled, i.e., changed from the function state to the address state or from the address state to the function state. After the function-address flag has been toggled, or if the function-address key test is negative, the sequence of operation cycles to the point where the glue-stitch subroutine is entered.

Turning now to the portion of the overall sequence illustrated in the lower left-hand corner of FIG. 5; if the program key press test is negative, i.e., no key is being pressed, a test of the run-program switch 125 is made. If the run-program switch is in the program position, the overall sequence cycles back to the point where the program key press test is made. This loop is repeated until a program key is pressed or the run-program switch 125 is shifted to the run position. When the test of the run-program switch 125 determines that the switch has been shifted to the run position, the wait loop just described is left and the glue pattern-kicker on calculate subroutine illustrated in FIG. 10 is entered.

The first step in the glue pattern-kicker on calculate subroutine is reading the rear glue pattern off position from the permanent memory. That is, the position at which the rear glue pattern is to be terminated is a fixed point that is identified by a particular numerical value in memory. This point can be fixed since it is a predetermined distance in front of the flight bar pushing a particular case through the machine. After the rear glue off position value has been read from memory, the glue pattern length value inserted by the operator in the manner previously described is subtracted from the rear glue pattern off position. The result of this subtraction produces a numerical value representing the point where the rear glue pattern is to start. This value, which represents the rear glue on position, is stored. Thereafter, the glue prime distance is subtracted from the rear glue on position to determine the point when the glue prime must be turned on in order for glue to be emitted at the rear glue on position. This numerical value is also stored in memory.

Figure 10:
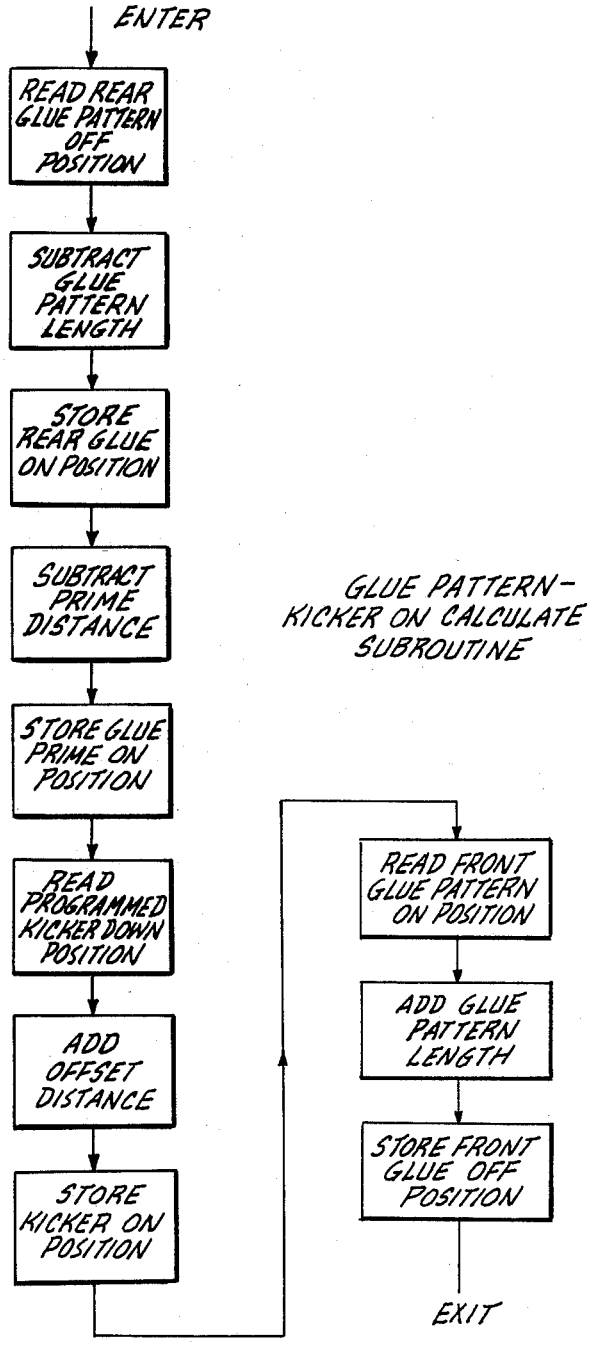
FIG. 10 is a flow diagram of a glue pattern-kicker on calculate subroutine suitable for inclusion in the overall sequence illustrated in FIG. 5.

The next step in the glue pattern-kicker on calculator subroutine illustrated in FIG. 10 is to read the programmed kicker down position. That is, as previously described, the operator can program the position at which the kicker is to be actuated down. This position is related to the height of the minor flap to be "kicked" forward and down by the kicker 59. The operator programs this factor. In order to allow an eight bit counter to be used in this subroutine, rather than a sixteen bit counter, a fixed offset is added to the operator programmed value. The use of an eight bit, as opposed to a sixteen bit counter in the program mode of operation results in the system being programmable in a shorter period of time. In any event, the result of the addition defines the kicker on position, which is stored for use during the hereinafter described run subroutine.

Next, the front glue on position is read from permanent memory. This position can be fixed because it occurs at a predetermined distance after the case impinges on the front of case switch. After the front glue on position has been read from memory, the glue pattern length value inserted by the operation is added to the front glue on position. The result of this addition produces a numerical value representing the point where the front glue pattern is to end. This value, which represents the front glue off position, is stored.

After the pass through the glue pattern-kicker on calculate subroutine (FIG. 10), as illustrated in FIG. 5, the program cycles to the initialize CPU registers; program I/O interface step. After a pass through this step, the run-program switch is again tested. If the run-program switch is still in the run position, the program cycles to the run subroutine illustrated in FIG. 11 and next described.

Figure 17:
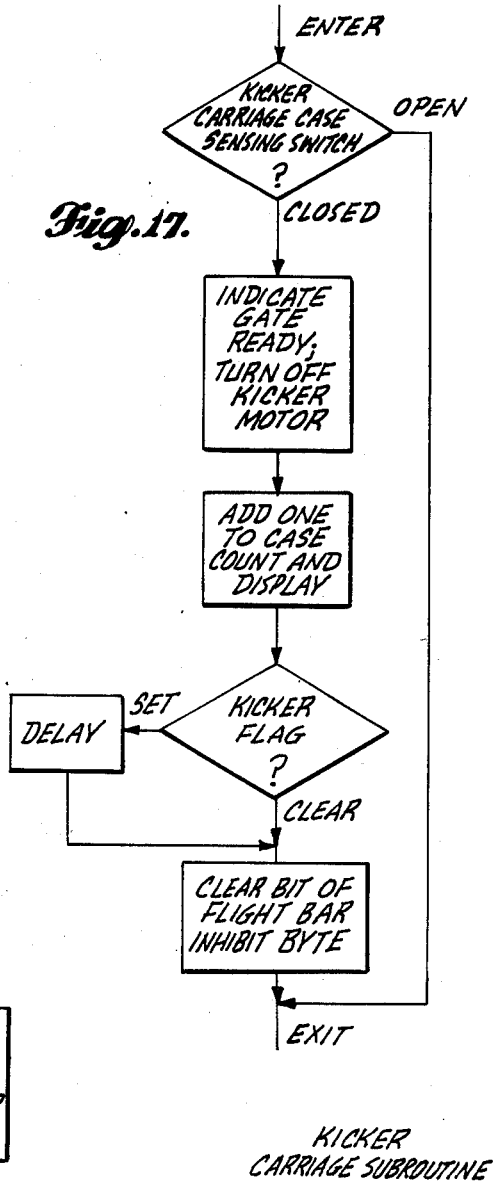
FIG. 17 is a flow diagram of a kicker carriage subroutine suitable for inclusion in the run subroutine illustrated in FIG. 11.
Figure 16:
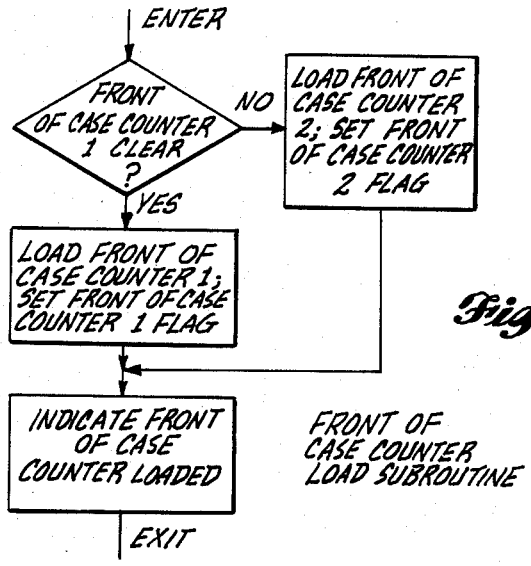
FIG. 16 is a flow diagram of a front of case counter load subroutine suitable for inclusion in the run subroutine illustrated in FIG. 11.

The first step in the run subroutine is the step of clearing all indicator flags used during the subroutine. Thereafter the run subroutine sequentially tests the bits of a parameter byte to determine which one of several infeed subroutines to follow, prior to making a pass through a count and compare subroutine. The infeed subroutines, in essence, control the entry of cases into the programmable random size case sealing machine and the lowering of the kicker carriage onto the entering cases. The infeed subroutines comprise: an open gate subroutine (FIG. 12); a case feed subroutine (FIG. 13); a close infeed rails subroutine (FIG. 14); a raise T-deck subroutine (FIG. 15); a front of case counter load subroutine (FIG. 16); and, a kicker carriage subroutine (FIG. 17). The count and compare subroutine (FIGS. 18A and B) controls the application of glue to the top and bottom flaps of the cases, in accordance with the way the machine is programmed.

The first parameter test in the run subroutine is a gate ready parameter test. (As will be understood from the following discussion, the gate ready parameter bit is set during the kicker carriage subroutine illustrated in FIG. 17). If the gate ready parameter bit is set, a pass is made through the open gate subroutine illustrated in FIG. 12. The first step in the open gate subroutine is a test to determine if the flight bars of the flight bar conveyor mechanism are in a position such that the gate rollers 38 can be lowered, i.e., the gate can be opened. In this regard, as previously discussed, the flight bars pass through an aperture that is open when the gate is closed and closed when the gate is open. As a result, it is necessary to test the position of the flight bars before the gate is opened. If any of the flight bars is positioned such that it would impinge on the gate rollers 38 if the gate is opened, the gate is not opened and the remaining steps of the open gate subroutine are bypassed. If the flight bar at gate open position test is positive, the gate switch 42 is tested to determine if it is open or closed. If the gate switch is open, indicating that the gate switch arm 41 is not being pressed down by a case, the remaining steps of the open gate subroutine are again bypassed. In this situation, a case is not available at the infeed side of the gate. If the gate switch 42 is closed, indicating that a case is available, the gate is opened. Thereafter, a gate open indication occurs and the infeed rails 48 are moved out by applying an actuation control signal to the infeed rails out actuator 49. The gate open indication clears the gate ready parameter bit and sets the next to be tested (gate open) parameter bit. Thereafter, the open gate subroutine ends and the run subroutine cycles to the count and compare subroutine illustrated in FIGS. 18A and B and described below.

If the gate ready parameter bit was not set, as illustrated in FIG. 11, the gate open parameter bit is tested. If the gate open parameter bit is set, a pass is made through the case feed subroutine illustrated in FIG. 13.

The first step in the case feed subroutine is a test of the case flap sensing switch 75 to determine if the switch is open or closed. If closed, indicating the switch light beam is impinging on the adjacent major flap of a carton entering the machine (meaning that the kicker carriage is too low), the kicker carriage motor 53 is energized (or remains energized) to raise the kicker carriage. If the case flap sensing switch is open, indicating that switch light beam is not impinging on the adjacent major flap, the kicker carriage motor is turned off (or commanded to remain off.)

After the kicker carriage motor is turned on or off based on the results of the case flap sensing switch test, a test is made to determine if the flight bar is at a flight bar inhibit position. In this regard, it is always necessary for flight bar movement to stop until some other action is complete. For example, in the situation of long cases it is necessary to stop flight bar movement until the power-driven rollers move the case past the gate switch arm 41 in order to prevent a flight bar from lifting the gate rollers. The position of the flight bar is determined by checking the value of the appropriate one of hereinafter described flight bar counters. If any of the flight bars is at a flight bar inhibit position, a flight bar inhibit bit is set. More specifically, as with the parameter byte, a flight bar inhibit byte is provided. Each bit of the flight bar inhibit byte is separately set and cleared during passes through the various subroutines forming part of the run subroutine. The bits of the flight bar inhibit byte are tested at the end of the count and compare subroutine. If all of the bits are clear the flight bar motor is turned on. If any of the bits is set the flight bar motor is turned off.

After the flight bar inhibit bit has been set, or if the flight bar is not at an inhibit position, the gate switch 42 is tested to determine if it is closed or open. If the gate switch is closed, indicating that a case is still in the gate, the remaining steps of the case feed subroutine are bypassed. Contrariwise, if the gate switch is open the gate actuator 40 is energized to close the gate. Then, the case flap sensing switch 75 is again tested to determine if it is closed or open. If the case flap sensing switch 75 is closed, indicating that the switch light beam is (still) impinging on the adjacent top major flap of a case, the remaining steps of the case feed subroutine are bypassed. Contrariwise, if the case flap sensing switch is open, indicating that the switch light beam is not impinging on an adjacent top major flap (meaning that the case flap sensing switch 75 is above the adjacent top major flap, which, in turn, means that the kicker carriage is suitably high), a gate closed indication occurs. This indication clears the gate open parameter bit and sets the next (gate closed) bit of the parameter byte. Thereafter, the infeed rails in actuators 49 are energized to move the infeed rails 48 toward a case located immediately upstream of the gate. At the same time a gate related flight bar inhibit bit is cleared and the kicker carriage motor is turned off. Next, the flight bar number for the case in the gate is determined and a flag related thereto is set. In this way the relationship of flight bars to the cases passing through the gate are identified. The identification is used to identify "busy" flight bar counters during passes through the count and compare subroutine (FIGS. 18A and 18B), as discussed below.

After the case feed subroutine has been completed, as illustrated in FIG. 11, a pass is made through the count and compare subroutine.

If the gate ready and the gate open parameters bits are both clear (FIG. 11), the gate closed parameter bit is tested. If the gate closed parameter bit is set, a pass is made through the close in-rails subroutine illustrated in FIG. 14 and next described.

The first step of the closed infeed rails subroutine is a test of the left and right infeed rails in switches 52A and 52B to determine if the switches are open or closed. If either switch is open, the remaining steps of the close infeed rails subroutine are bypassed. If both the left and right infeed rail in switches 52A and 52B are closed, the infeed rail actuators are balanced. As will be readily appreciated by those familiar with pneumatic actuators, the infeed rail actuators and, thus, the infeed rails are balanced by pressure balancing the actuators. As a result of balancing, the infeed rails (and, thus, the case between the infeed rails) are centered along the case path of travel through the random size case sealing machine.

After the infeed rail actuators have been balanced, an infeed rails in indication occurs. This indication clears the gate closed parameter bit and sets the next (infeed rails in) bit of the parameter byte. Thereafter, the T-deck, which is now beneath the case that just entered the random size case sealing machine, is dropped. Dropping of the T-deck, as previously described, allows the center region of the bottom major flaps to separate from the bottom minor flaps, unless the bottom major and minor flaps are sealed. If they are sealed, of course, the bottom major flaps do not separate from the bottom minor flaps when the T-deck is dropped.

Figure 14:
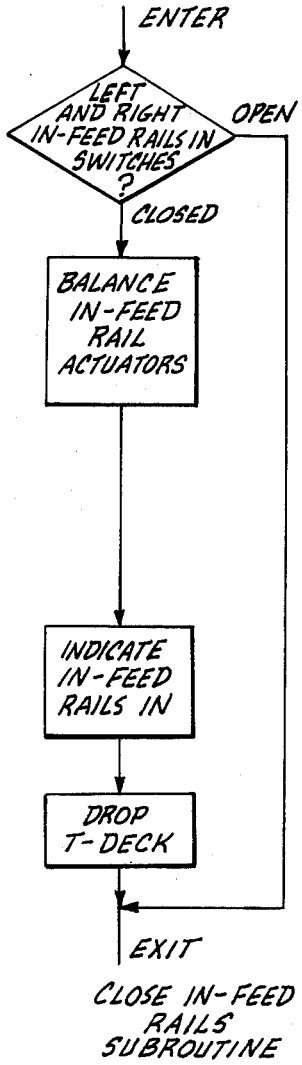
FIG. 14 is a flow diagram of a close-in-feed rails subroutine suitable for inclusion in the run subroutine illustrated in FIG. 11.
Figure 15:
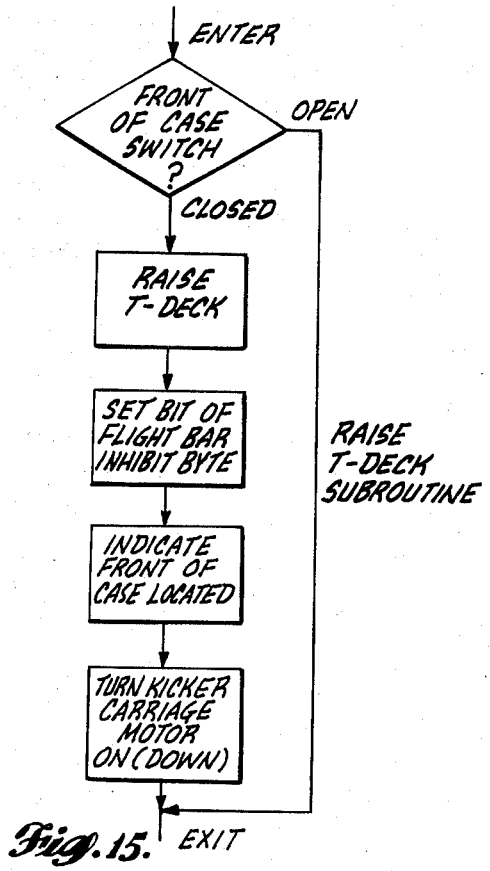
FIG. 15 is a flow diagram of a raise T-deck subroutine suitable for inclusion in the run subroutine illustrated in FIG. 11.
Figure 18A:
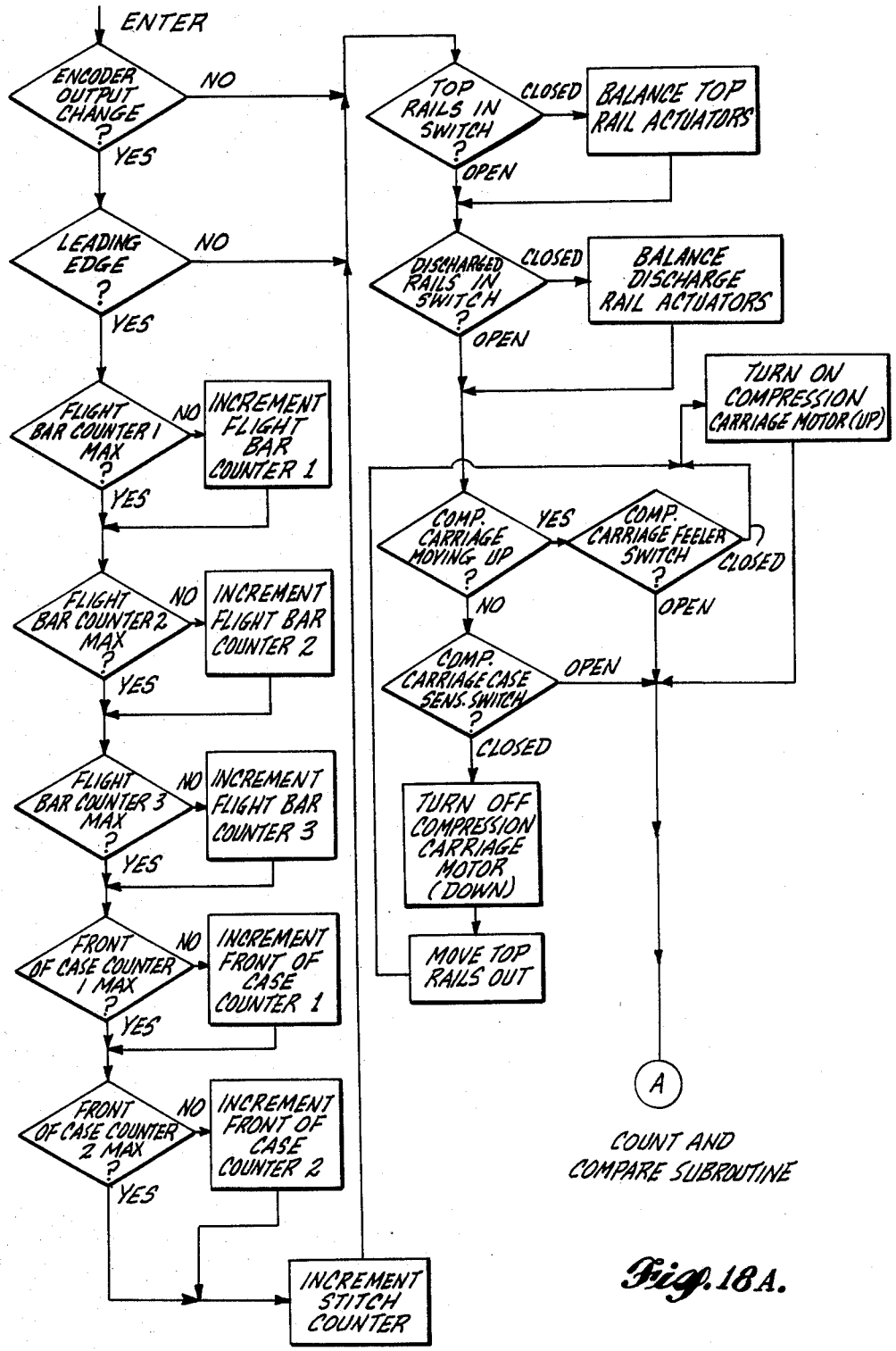
FIGS. 18A and 18B are a flow diagram of a count and compare subroutine suitable for inclusion in the run subroutine illustrated in FIG. 11.
Figure 18B:
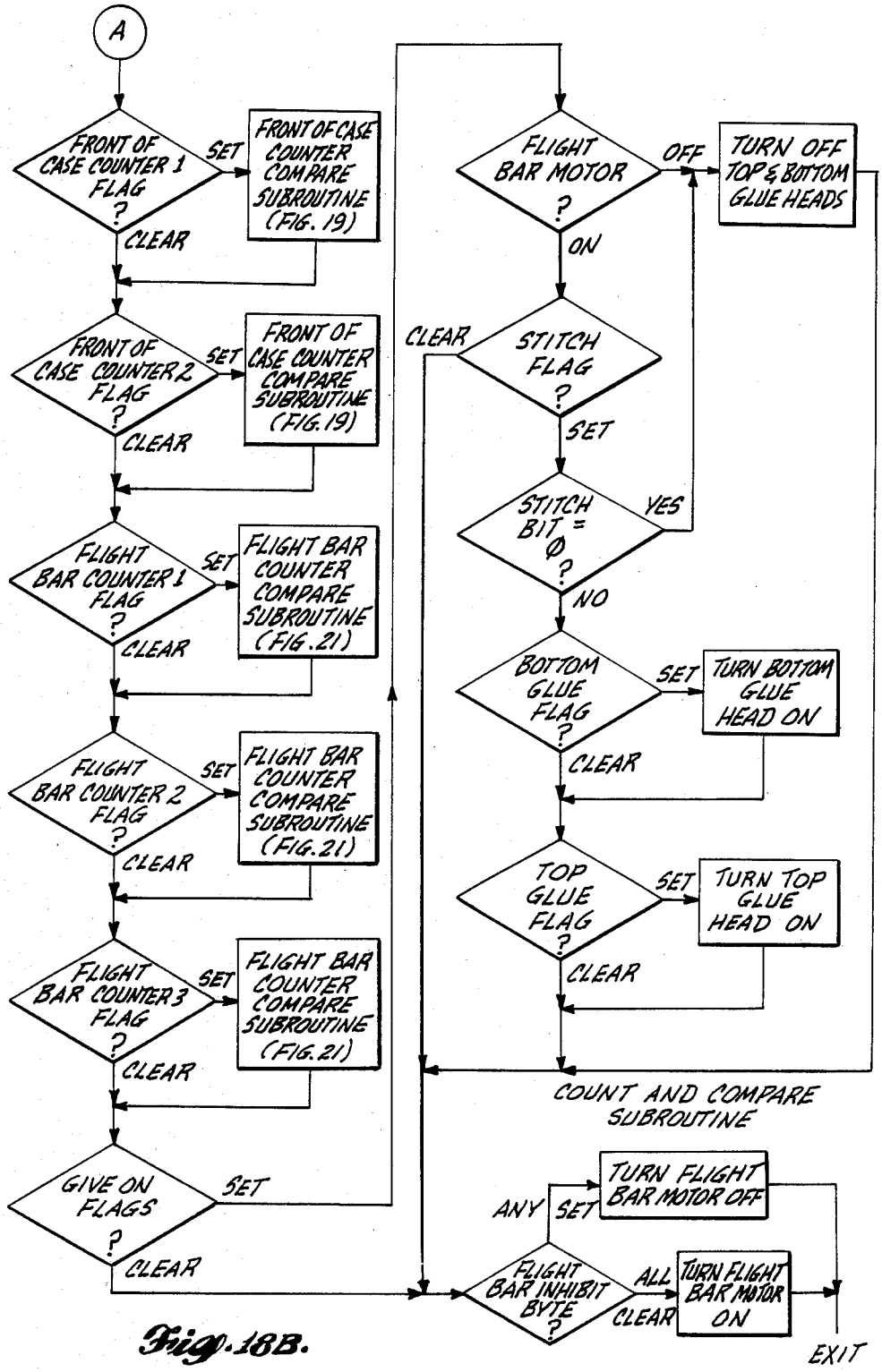

After a pass is made through the close infeed rails subroutine illustrated in FIG. 14, a pass is made through the count and compare subroutine illustrated in FIGS. 18A and 18B and described below.

Returning now to FIG. 11, if the gate closed parameter bit is clear, the infeed rails in parameter bit is tested. If the infeed rails in parameter bit is set, a pass through a raise T-deck subroutine illustrated in FIG. 15 and next described is made.

The first step in the raise T-deck subroutine is a test of the front of case switch 117 to determine if it is open or closed. The front of case switch is located slightly downstream of the plow 46 within which the bottom glue head 47 is located. As a result, when the front of case switch is closed, the plow has entered the region between the bottom major flaps and the bottom minor flaps, if the bottom major flaps separated from the bottom minor flaps when the T-deck was dropped.

If the front of case switch is open, the remaining steps of the raise T-deck subroutine are bypassed. If the front of case switch is closed, the T-deck actuator 43 is energized to raise the T-deck. Thereafter, a kicker associated bit of the flight bar inhibit byte is set and, then, a front of case located indication occurs. This indication clears the infeed rails in parameter bit and sets the next (front of case located) bit of the parameter byte. Thereafter, the kicker carriage motor is turned on to move the kicker carriage in the down direction, which is the last step in the raise T-deck subroutine. After a pass through the raise T-deck subroutine, a pass is made to the count and compare subroutine illustrated in FIGS. 18A and 18B and described below.

As illustrated in FIG. 11, if the infeed rails in parameter bit is clear, the front of case located parameter bit is tested. If the front of case located parameter bit is set, a pass is made through the front of case counter load subroutine illustrated in FIG. 16. Prior to describing this subroutine, if is pointed out that the program controls two front of case counters, which are utilized to independently keep track of the location of the front of two cases simultaneously moving in seriatim through the preferred embodiment of the random size case sealing machine. Prior to a third case entering the machine, one of these case counters must be cleared in the manner hereinafter described. As a result, the first step in front of case counter load subroutine is a test of front of case counter 1 to determine if it is clear. If front of case counter 1 is not clear, a predetermined value is loaded into front of case counter 2; and, a front of case counter 2 flag is set. The numerical value loaded into front of case counter 2 is related to the position of the front of case switch. If front of case counter 1 is found to be clear, the predetermined numerical value is loaded into front of case counter 1; and a front of case counter 1 flag is set. After one or the other of front of case counters is loaded in the manner just described, a front of case counter loaded indication occurs. This indication clears the front of case located parameter bit and sets the next (front of case counter loaded) bit of the parameter byte. Thereafter, the front of case counter load subroutine ends and a pass is made through the count and compare subroutine illustrated in FIGS. 18A and 18B and described below.

Returning to FIG. 11, if the front of case located parameter bit is clear, a test is made of the front of case located parameter bit. If the front of case located parameter bit is set, a pass is made through the kicker carriage subroutine illustrated in FIG. 17 and next described.

The first step in the kicker carriage subroutine is a test of the kicker carriage sensing switch 57 to determine if it is open or closed. If the fork paddle 55 that actuates the kicker carriage sensing switch has not been raised to a position whereat it closes this switch (i.e., the kicker carriage case sensing switch is open), the remaining steps of the kicker carriage subroutine are bypassed and the run subroutine cycles to the count and compare subroutine illustrated in FIGS. 18A and 18B. If the kicker carriage case sensing switch is closed, a gate ready indication occurs. This indication clears the front of case counter loaded parameter bit and sets the gate ready parameter bit described above. At the same time the kicker motor is turned off. Then, one is added to the case count and the case count value is displayed on alphanumeric display 133 (FIG. 4). After the case count value has been displayed, a kicker flag set during the count and compare subroutine in the manner hereinafter described is tested. If the kicker flag is set, a predetermined delay (300 milliseconds, for example) occurs. In actual practice the kicker flag will only be set during a pass through the kicker carriage subroutine if the case being sealed is nearly square. In the situation of oblong cases, the rear minor flap will be kicked on the fly, i.e., without the flight bar motor being stopped. After the delay, or if the kicker flag is clear, a related bit of the flight bar inhibit byte is cleared. Thereafter, the kicker carriage subroutine ends and the run subroutine cycles to the count and compare subroutine illustrated in FIGS. 18A and 18B and next described.

The first step in the count and compare subroutine is a test of the output of the chain position encoder 123 to determine if the output has changed since the last test, i.e., from high to low or from low to high. If the encoder output has not changed, the count and compare subroutine cycles to a top rails in switch test described below. If the encoder output has changed, a test is made to determine if the change is a leading edge change or a trailing edge change. A low to high change designates a leading edge change and a high to low change designates a trailing edge change. If the change in the output of the encoder is not a leading edge change, the count and compare subroutine again cycles to the top rails in switch test described below. If the change is a leading edge change, a flight bar counter 1 max test is performed.

As will be readily appreciated from the foregoing description, the two tests that occur at the beginning of the count and compare subroutine result in the count and compare subroutine only recognizing the occurrence of a pulse in the output of the chain position encoder at the time the leading edge of the pulse occurs. As a result, a single pulse cannot be recognized (and counted) twice.

The flight bar counter 1 max test is a test to determine if flight bar counter 1 has counted to a predetermined maximum value stored in memory for comparison purposes. If the value stored in flight bar counter 1 (at the time the test is performed) is not at the predetermined maximum value, flight bar counter 1 is incremented by one. After flight bar counter 1 has been incremented, or if flight bar counter 1 is found to be at its maximum value, a flight bar counter 2 max test is performed. Again, this test is performed by comparing the count value stored in flight bar counter 2 at the time the test is performed with the predetermined maximum value. If flight bar counter 2 is not at its maximum value, flight bar counter 2 is incremented. After flight bar counter 2 is incremented or if flight bar counter 2 is found to be at its maximum value, flight bar counter 3 is tested to determine if it is at the predetermined maximum value. If flight bar counter 3 is not at the predetermined maximum value, flight bar counter 3 is incremented. As will be readily appreciated from the foregoing description, each of three flight bar counters is incremented each time a leading edge of a pulse produced by the encoder is detected. The flight bar counters are incremented until they reach a maximum value and then stopped. Flight bar counters at their maximum value are reset during a pass through the synchronizing subrouting illustrated in FIG. 22 and described below.

As will also be appreciated from the foregoing description the incremented flight bar counters track the movement of three flight bars through the random size case sealing machine of the invention. Tracking is accomplished because the counters are incremented by the pulses produced by the chain position encoder, and because a pulse is produced each time the chain 21 and, thus, the flight bars move a predetermined increment of distance. Three counters are necessary because, while the machine only simultaneously processes two cases at a time, the flight bar approaching the gate to pick up the next case must be tracked at the same time the flight bar moving a case through the discharge rails is tracked. At the same time a flight bar located between these two flight bars (in the region of the kicker carriage) must also be tracked. The same is not true of the hereinafter discussed front of case counters. Only two such counters are required because it is not necessary to track the front of an exiting case after the case reaches a predetermined point under the compression carriage, which point is reached before the entering case reaches the front of case switch 117.

Returning to FIG. 18A, after flight bar counter 3 has been incremented or if flight bar counter 3 is found to be at the predetermined maximum value, front of case counter 1 is tested to determine if it is at a predetermined maximum value stored in memory. (As previously described, there are two front of case counters, each of which tracks the position of the front of the case of one of two cases being simultaneously moved through the machine.) The predetermined maximum value chosen for the front of case counters is usually different than the predetermined maximum value chosen for the flight bar counters.

If front of case counter 1 is not at the predetermined maximum value it is incremented. After front of case counter 1 has been incremented or if front of case counter 1 is found to be at the predetermined maximum value, front of case counter 2 is tested to determine if it is at the predetermined maximum value. If front of case counter 2 is not at the predetermined maximum value it is incremented. Thus, the front of case counters are incremented (until they reach a maximum value) each time a leading edge of a pulse produced by the chain position encoder 123 is detected.

After front of case counter 2 has been incremented or if front of case counter 2 is found to be at the predetermined maximum value, a stitch counter is incremented. The stitch counter is tested and the result utilized to control the intermittent or stitch operation of the glue heads when the stitch function is programmed, as illustrated in FIG. 18B and described below.

After the stitch counter has been incremented, the top rails in switch test, noted above, occurs. (The top rails are commanded to move in during a pass through a front of case counter compare subroutine illustrated in FIG. 19 and described below.) If the top rails in switch test determines that the top rails in switch 67 is closed (indicating that the switch arm is impinging on a case located between the top rails), the top rail actuators are balanced in the manner previously described with respect to the infeed rails. That is, the actuators are pressure equalized to balance (e.g., center) the rails on opposite sides of the center of the case path travel through the random size case sealing machine. As a result, the case is centered along the case path of travel, beneath the kicker carriage.

After the top rail actuators have been balanced or if the top rails in switch is open, the discharge rails in switch 94 is tested to determine if it is closed or open. If the discharge rails in switch is found to be closed (indicating that the switch arm is impinging on a case located between the discharge rails), the discharge rail actuators are balanced in the same manner as the infeed and top rail actuators. As a result, a case located between the discharge rails is centered beneath the compression carriage. (The discharge rails are also commanded to move in during a pass through the front of case counter compare subroutine illustrated in FIG. 19 and described below.)

After the discharge rail actuators have been balanced or if the discharge rails in switch is determined to be open, a test is made to determine if the compression carriage is moving up. This test is accomplished by testing the CPU command applied to the compression motor 80 via the output interface 111. If the compression carriage motor 80 is not being commanded to move the compression carriage up, a test is made to determine if the compression carriage case sensing switch 86 is open or closed. If the compression carriage case sensing switch 86 is closed, meaning that the compression carriage has been lowered to a point where compression carriage case sensing switch arm 87 is closing the compression carriage case sensing switch, compression carriage motor down movement is commanded to terminate (or remain terminated). Thereafter, the top rails out actuators 65 are energized to move the top rails 63 out, i.e., away from the path of travel of a case through the random size case sealing machine. After the move top rails out command has occurred, the count and compare subroutine cycles to a turn off compression carriage motor (up) command illustrated on the right side of FIG. 18A and described in more detail below. If the compression carriage case sensing switch is determined to be open, the count and compare subroutine cycles to a front of case counter 1 flag test illustrated in FIG. 18B and described below.

If the compression carriage moving up test was positive, i.e., the compression carriage motor 80 was being commanded to move the compression carriage 81 up, the compression carriage feeler switch 89 is tested to determine if it is closed or open. If the compression carriage feeler switch is open (meaning that the compression and kicker carriages are at the same elevation or the elevation difference is less than an amount necessary to close the compression carriage feeler switch), the count and compare subroutine cycles to the front of case counter 1 flag test illustrated in FIG. 18B and described below.

If the compression carriage feeler switch is determined to be closed (meaning that the compression carriage is above the kicker carriage by a predetermined amount adequate for the case to move beneath the kicker carriage), the turn off compression carriage motor (up) command referenced above occurs. Thus, the compression carriage 81 is maintained within a predetermined elevational distance of the kicker carriage 51. After the turn off compression carriage motor (up) command occurs, the count and compare subroutine cycles to the front of case counter 1 flag test illustrated in FIG. 18B.

The front of case counter 1 and front of case counter 2 flags are set during the front of case counter load subroutine (FIG. 16) previously described. As illustrated in FIG. 18B, the next steps in the count and compare subroutine is to sequentially test these flags and based on these tests make a pass through a front of case counter compare subroutine illustrated in FIG. 19 and described below. That is, if either flag is set a pass is made through the front of case counter compare subroutine. The pass tests the state of the related front of case counter by comparing the state of the counter with stored numerical values, when a comparison occurs a related machine function is commanded. If the flags associated with both of the front of case counters are set two sequential passes are made through the front of case counter compare subroutine.

Figure 19:
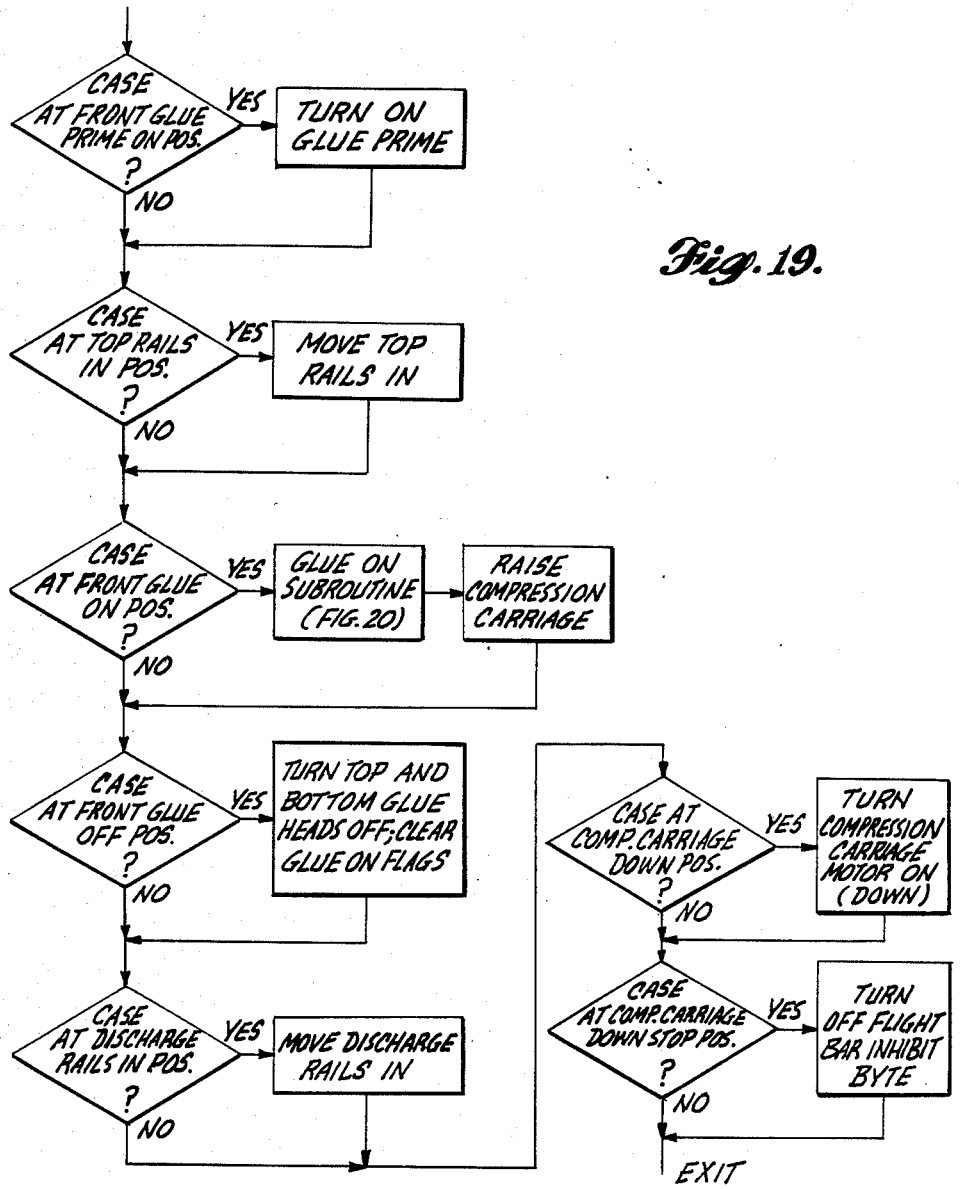
FIG. 19 is a flow diagram of a front of case counter compare subroutine suitable for inclusion in the count and compare subroutine illustrated in FIGS. 18A and 18B.

The first step in the front of case counter compare subroutine illustrated in FIG. 19 is a test of the state of the front of the case counter (whose set flag caused the pass through the front of case counter compare subroutine) to determine if the numerical value of the front of the case counter being tested indicates that the front of the case is at the glue prime on position for the front glue pattern. In this regard, the front glue pattern is controlled by testing the state of the front of case counters against numerical values stored in memory. As previously noted that front glue on position is fixed, as is the front glue prime on pposition. The front glue off position is calculated during a pass through the glue pattern kicker-on calculate subroutine. For any particular case the position of the front of the case with respect to the closure of the front of case switch is known after the front of case has been detected by the front of case switch in the manner previously described. It is the closure of the front of case switch that synchronizes the front of case counters. As a result, even though fixed, front glue on and front glue prime on occurances are controllable by the front of case counters. In any event, if the count value stored in the front of the case counter being tested is the same as the predetermined glue prime on value, the glue prime actuator 163 is energized.

After the glue prime actuator has been energized or if the case is not at the front glue prime on position, a test is made to determine if the case is at the top rails in position. Again, this test is accomplished by comparing the state of the front of case counter whose flag was set with a predetermined numerical value stored in memory. If the case is at the top rails in position, the top rails in actuators 64 are energized to move the top rails in. After the top rails in actuators have been energized, or if the case is not at the top rails in position, a test of the front of case counter is made to determine if the case is at the front glue on position. Again, this is accomplished by comparing the state of the front of case counter whose flag was set with a predetermined value stored in memory. If the case is at the front glue on position, a pass is made through a glue on subroutine illustrated in FIG. 20 and next described.

The first step in the glue on subroutine is a test of the top glue head on/off function flag set by the operator when the random size case sealing machine was programmed in the manner previously described. If this flag is set, the top glue fire actuator 169 is energized; and, a top glue on flag is set. After the top glue head has been turned on and the top glue on flag has been set, or if the top glue on/off function flag was clear, a test of the bottom glue head on/off function flag is made. As with the top glue head on/off function flag, the bottom glue head on/off function flag was set or cleared by the operator when the random size case sealing machine was programmed in the manner previously described. If the bottom glue on/off function flag is set, the bottom glue fire actuator 171 is energized and a bottom glue on flag is set. After the bottom glue head has been turned on and the bottom glue on flag set, or if the bottom glue head on/off function flag was clear, the glue on subroutine ends and a raise compression carriage command (FIG. 19) occurs. The raise compression carriage command causes the compression carriage motor 80 to be energized so as to raise the compression carriage 81.

After the raise compression carriage command occurs or if the case is not at the front glue on position, a test of the front of box counter whose set flag caused the pass through the front of case counter compare subroutine is made to determine if the case is at the front glue off position, as illustrated in FIG. 19. This test is accomplished by comparing the state of the front of case counter with the stored value calculated during the glue pattern kicker-on calculate subroutine. If the case is at the front glue off position, the top and bottom glue heads are turned off by deenergizing the top and bottom glue fire actuators 169 and 171. At the same time, the top and bottom glue on flags are cleared.

After the top and bottom glue heads have been turned off and the top and bottom glue on flags have been cleared, or if the case is not at the front glue off position, a test of the front of case counter is made to determine if the case is at the discharge rails in position. Again, this test is accomplished by comparing the state of the front of case counter whose set flag caused the pass through the front of case counter compare subroutine with a predetermined numerical value. If the case is at the discharge rails in position, the discharge rails in actuators 92 are energized, causing the discharge rails to be moved in.

After the discharge rails in command has occurred, or if the case is not at the discharge rails in position, a test of the front of case counter is made to determine if the case is at the compression carriage down position. If the case is at the compression carriage down position, the compression carriage motor 80 is turned on so as to move compression carriage down. After the compression carriage motor has been commanded on, or if the case is not at the compression carriage down position, a test of the front of case counter is made to determine if the case is at the compression carriage down stop position. Again, this test is accomplished by comparing the state of the front of case counter whose flag was set with a predetermined numerical value. If the case is at the compression carriage down stop position, a compression carriage bit of the flight bar inhibit byte is set. After the bit has been set, or if the case is not at the compression carriage down stop position, the front of case counter compare subroutine ends and the sequence of operation cycles to the count and compare subroutine (FIG. 18B).

Figure 13:
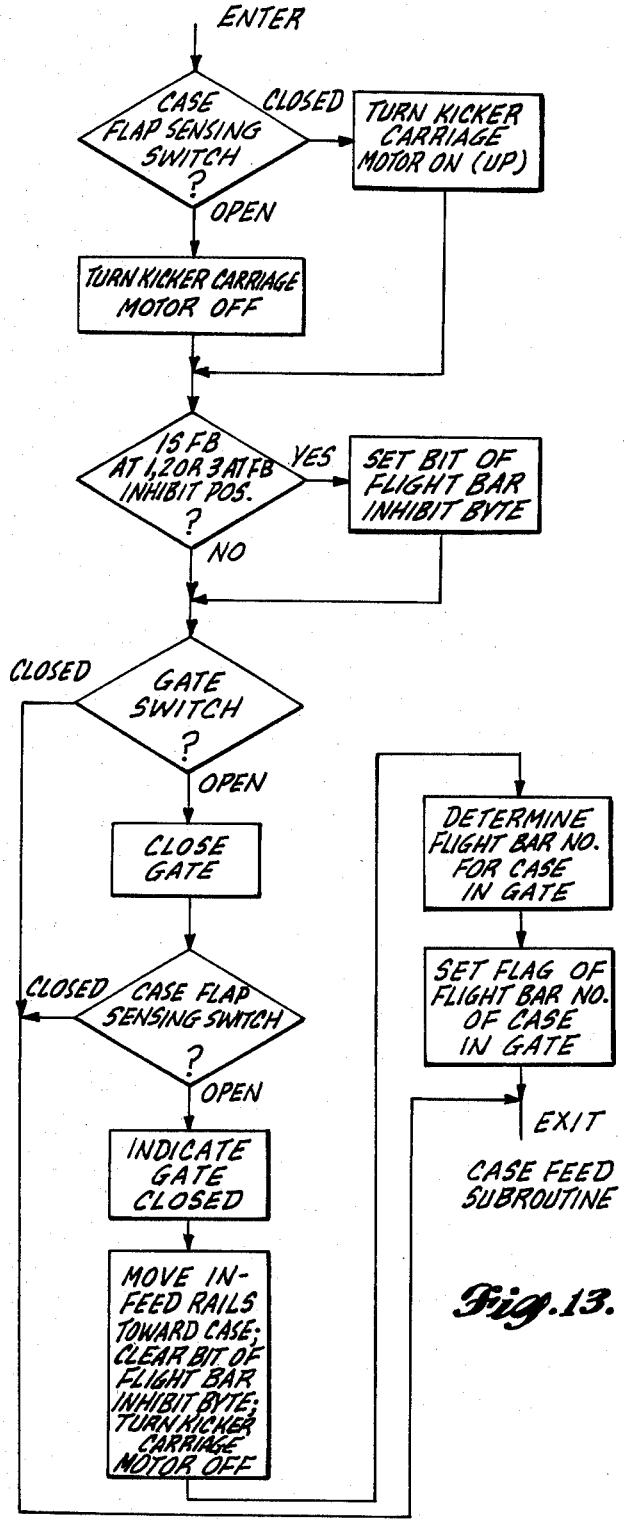
FIG. 13 is a flow diagram of a case feed subroutine suitable for inclusion in the run subroutine illustrated in FIG. 11.

After the flags of the front of case counters have been tested and appropriate passes made through the front of case counter compare subroutine (FIG. 19) the flags of three flight bar counters are sequentially tested. Any found not to be set cause a pass to be made through a flight bar counter compare subroutine illustrated in FIG. 21 and next described. As will be recalled, the flight bar counter flags are set during the case feed subroutine (FIG. 13).

The first step in the flight bar counter compare subroutine is a test to determine if the flight bar associated with the flight bar counter that caused the pass through the flight bar counter compare subroutine is in the kicker-on position, which position is calculated during the glue pattern kicker-on calculate subroutine (FIG. 10) previously described. If the flight bar is at the kicker-on position position, the kicker flag is set. After the kicker flag has been set or if the flight bar is not at the kicker-on position, the flight bar counter is tested to determine if the flight bar is at the kicker-off position, which is a predetermined position stored in memory. If the flight bar whose counter caused the pass through the flight bar compare subroutine is at the kicker-off position, the kicker flag is cleared.

After the kicker flag has been cleared, or if the flight bar is not at the kicker-off position, a test is made to determine if the kicker should be turned on or off. This test is made by determining if both the kicker carriage case sensing switch 57 is closed and the kicker flag is set. If both the switch is closed and the flag is set, the kicker is turned on by energizing the kicker actuator 161. If the sensing switch is open and/or the kicker flag is clear, the kicker is turned off, or commanded to remain off.

Figures 20, 21:
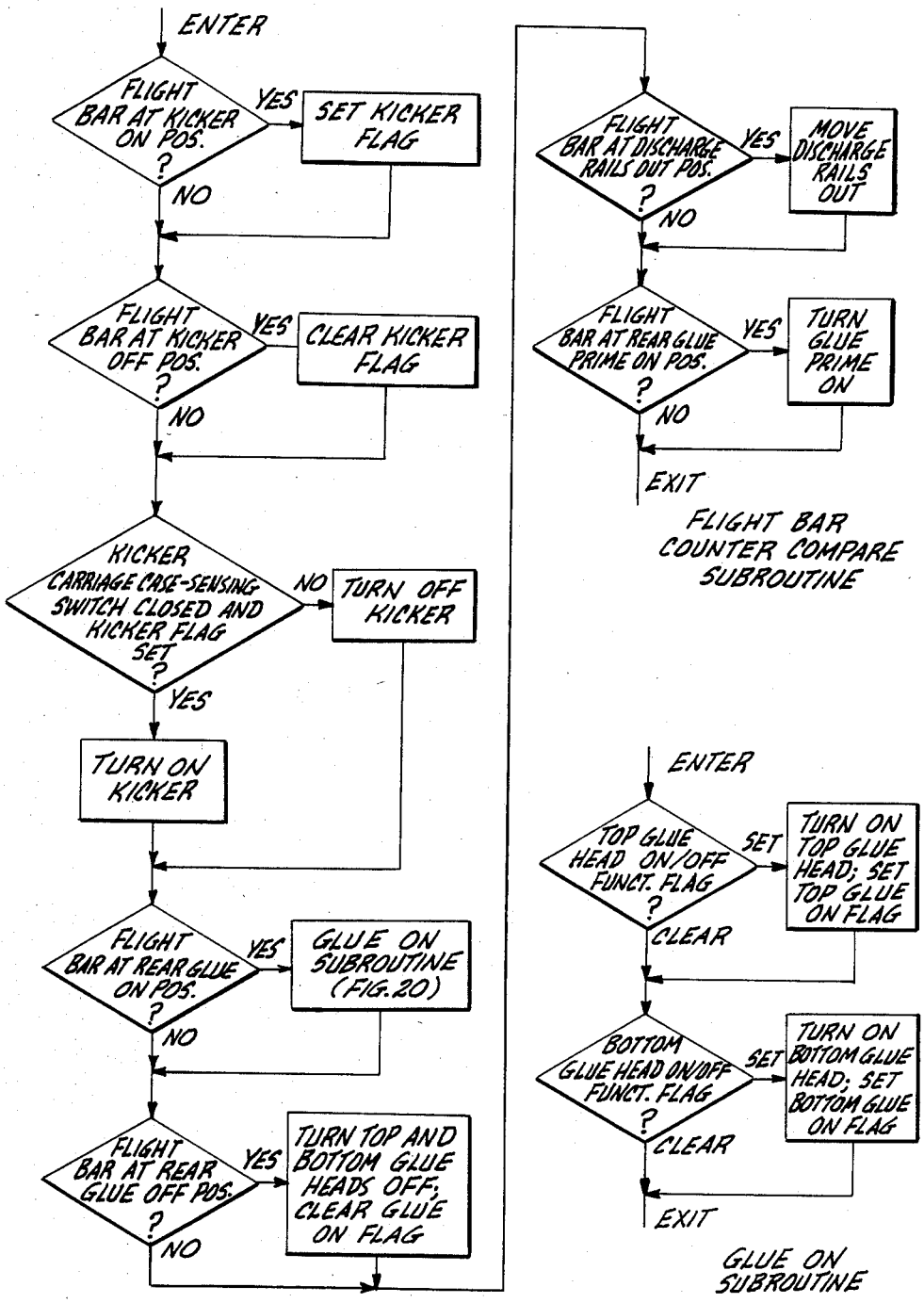
FIG. 20 is a flow diagram of a glue on subroutine suitable for inclusion in the front of case counter compare subroutine illustrated in FIG. 19.
FIG. 21 is a flow diagram of a flight bar counter compare subroutine suitable for inclusion in the count and compare subroutine illustrated in FIGS. 18A and 18B; and, FIG. 22 is a flow diagram of a sync interrupt subroutine suitable for use by the central processing unit (CPU) illustrated in FIG. 4.

After the kicker has been turned on or off, depending upon the results of the foregoing combination test, a test is made to determine if the flight bar is at the rear glue on position. As with the other position tests, this test is accomplished by comparing the state of the flight bar counter causing the pass through the flight bar counter with a value stored in memory. In this case the value is the operator controlled. More specifically, the rear glue on position value was calculated and stored during the previously described glue pattern kicker-on calculate subroutine (FIG. 10) based on the glue pattern length value programmed by the operator. If the flight bar is at the rear glue on position, a pass is made through the previously described glue on subroutine (FIG. 20). If the flight bar is not at the rear glue on position, or after the pass through the glue on subroutine, a test is made to determine if the flight bar is at the rear glue-off position, which is a predetermined position stored in memory. If the flight bar is at the rear glue-off position, the top and bottom glue heads are turned off and the glue on flag is cleared.

After the top and bottom glue have been turned off and the glue on flag has been cleared, or if the flight bar is not at the rear glue off position, a test of the flight bar counter is made to determine if the flight bar is at the discharge rails out position. If the flight bar is at the discharge rails out position, the discharge rails out actuators 93 are energized to move the discharge rails out. After the discharge rails have been commanded to move out, or if the flight bar is not at the discharge rails out position, a test is made to determine if the flight bar is at the rear glue prime on position. If the flight bar is at the rear glue prime on position, which position was calculated during the glue pattern kicker-on subroutine (FIG. 10) the glue prime actuator 163 is energized. In this regard, it should be noted that while the flight bar at rear glue prime on position test occurs in after the turning on and turning off of the glue heads during a pass through the flight bar compare subroutine, the squential location of this or any of the other tests performed during a pass through this or other position comparison subroutines is unimportant. The sequence is unimportant because only the machine function determined by the state of the flight bar counter causing the pass actually occurs, if any machine function occurs at all. Other machine functions are commanded and occur during later (or earlier) passes.

After the glue prime has been commanded on or if the flight bar counter is not at the rear glue prime-on position, the flight bar counter compare subroutine ends and the sequence returns to the count and compare subroutine.

After all of the flight bar counters have been tested and passes made through the flight bar counter compare subroutine for those flight bar counters whose flags are set, a test of the glue on flags is made. If both of the glue on flags are clear, the counter and compare subroutine ends and the sequence of operation cycles to the gate ready parameter test (FIG. 11) previously described.

If either of the glue on flags are set, a test is made to determine if the flight bar motor is on or off. This test is accomplished by testing the flight bar motor command sent by the CPU to the flight bar motor 24 via the output interface 111. If the flight bar motor is off, the top and bottom glue are turned off or (commanded remain off) and the sequence of operation cycles to the gate ready parameter test.

If the flight bar motor is on, a test is made of the stitch flag, programmed by the operator in the manner previously described, to determine if it is set or clear. If the stitch flag is clear, the sequence of operation cycles to a flight bar inhibit byte test. At this point it should be noted that, if a case is at a suitable location, the top and/or the bottom glue heads are continuously emitting glue (if programmed to emit glue) as a result of a pass through either a front of case counter or a flight bar counter compare subroutine. The remaining steps of the count and compare subroutine are followed in the event intermittent (e.g., stitch) front and rear patterns (rather than continuous glue patterns) are required because it is necessary to turn the glue on and off in order to create an intermittent pattern.

If the stitch flag is set, the stitch counter is tested to determine if its most significant bit (MSB) is equal to zero. If the bit is equal to zero, the top and bottom glue heads are turned off and the sequence of operation cycles to the flight bar inhibit byte test. If the "stitch" bit is not equal to zero, a test is made to determine if the bottom glue flag is set. If the bottom glue flag is set, the bottom glue head is turned on by energizing the bottom glue actuator 171. After the bottom glue head has been turned on, or if the bottom glue flag is clear, a test is made of the top glue flag to determine if it is set or clear. If the top glue flag is set, the top glue head is turned on by energizing the top glue fire actuator 169. After the top glue head is turned on, or if the top glue flag is clear, the flight bar inhibit byte test occurs.

The flight bar inhibit byte test determines if any bit of the flight bar inhibit byte is set. If any bit is set the flight bar motor is turned off (or commanded to remain off). If all of the bits of the flight bar inhibit byte are clear the flight bar motor is turned on (or commanded to remain on). After the flight bar inhibit byte is tested and the flight bar motor turned on or off, as appropriate, the count and compare subroutine ends and the sequence of operation cycles to the gate ready parameter test illustrated in FIG. 11 and previously described.

Figure 22:
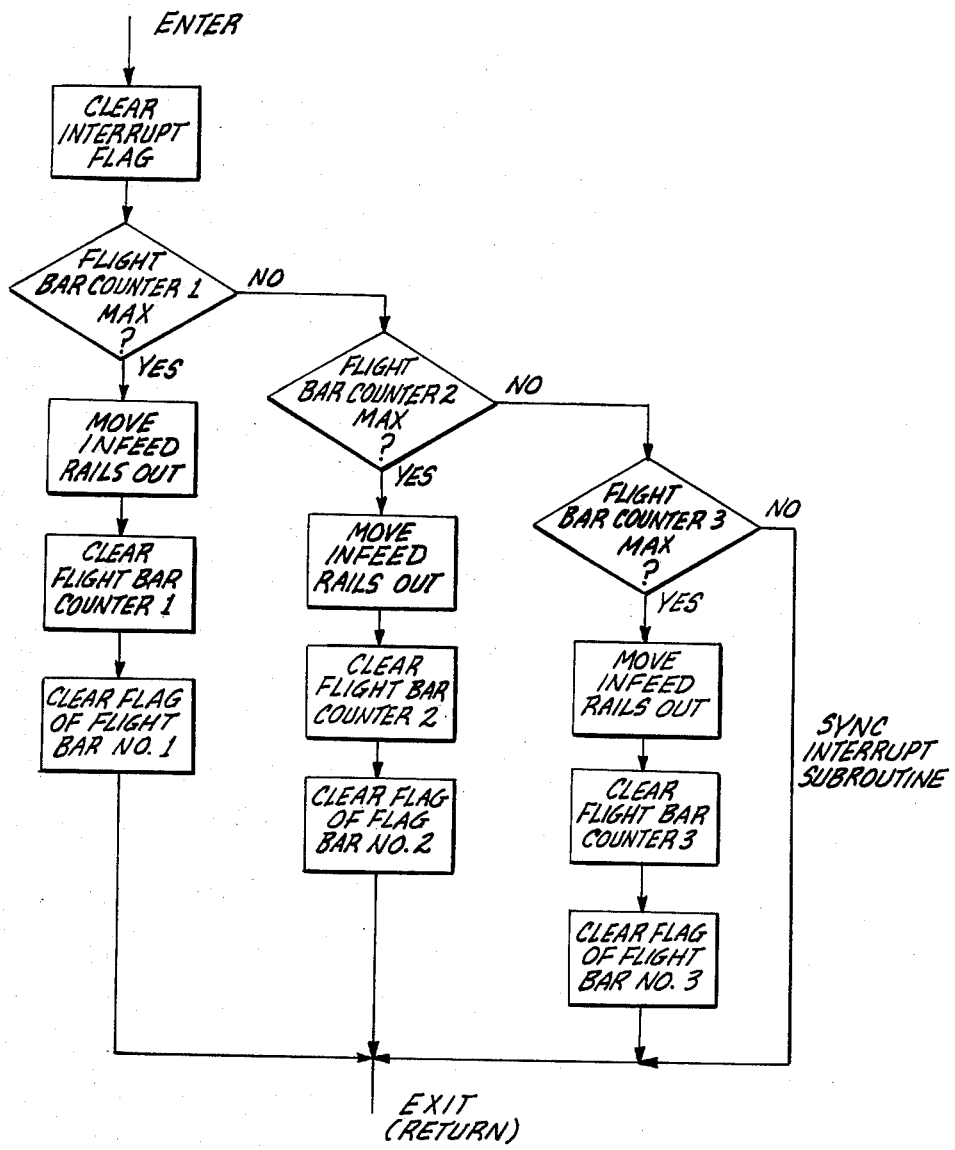

As previously noted, the flight bar counters are cleared and their flags reset during a pass through a sync interrupt subroutine. A suitable sync interrupt subroutine is illustrated in FIG. 22. Each time one of the flight bars reaches a predetermined positioned, the flight bar sync switch 121 is closed, which closure causes an interrupt pulse. In accordance with conventional microprocessor technology, the pulse sets an interrupt flag. When the interrupt flag is set, the CPU completes any step it is in the process of carrying out. Thereafter a pass is made through the interrupt subroutine. After the pass, the CPU returns to the point in the normal sequence of operation it was at when the interrupt occurred.

The first step in the sync interrupt subroutine is clearing the interrupt flag. Thereafter, a test is made of flight bar counter 1 to determine if it is at a predetermined maximum value. If flight bar counter 1 is at the predetermined maximum value, the infeed rails are moved over by energizing the infeed rails out actuators 50. Thereafter, flight bar counter 1 is cleared (i.e., set to a zero or some other sum fixed numerical value) and, the flag for flight bar counter 1 is cleared. After these actions take place, the sync interrupt subroutine ends and the sequence of operation cycles to the point in the normal sequence left when the interrupt occurred, as previously described. If flight bar counter 1 not at the predetermined maximum value, a test is made to determine if flight bar counter 2 is at the predetermined maximum value. If flight bar counter 2 is at the predetermined maximum value, the infeed rails are moved out. Thereafter, flight bar counter 2 and its flag are cleared. Then, the sequence of operation cycles to the point in the normal sequence left when the interrupt occurred. If flight bar counter 2 is not at the predetermined maximum value, a test is made of flight bar counter 3 to determine if it is at the predetermined maximum value. If flight bar counter 3 is at the predetermined maximum value, the infeed rails are moved out. Thereafter, flight bar counter 3 and its flag are cleared. After flight bar counter 3 and its flag have been cleared, or if flight bar counter 3 is not at the predetermined maximum value (indicating a false interrupt), the sync interrupt subroutine ends and the sequence of operation cycles to the point in the normal sequence left when the interrupt occurred.

As will be readily appreciated from the foregoing description, the invention provides a programmable random size case sealing machine. Cases are prevented from entering the case sealing machine until the flight bar conveyor mechanism that moves cases through the machine is in a position such that the flight bars will not impinge on a control gate if the gate is lowered. If other machine conditions are also met, the gate is lowered and a case is moved into the machine. As the case enters the machine, a photoelectric switch determines if a kicker carriage must be raised by sensing the height of the adjacent major flap of the entering case. If the carriage must be raised, it is raised. As the case moves further into the machine, the front of the case is detected. When this occurs a front of case counter is cleared and a related flag set. Thereafter, the "assigned" counter ("tracks" front of the case as it moves through the machine. The rear of the case is tracked by a flight bar counter that "tracks" the position of the flight bar that pushes the case through the machine. After the case enters the machine, a T-deck drops to allow the bottom major flaps to separate from the bottom flaps, if the bottom of the case is not sealed. As the case is moved through the machine, the kicker carriage is lowered, the front flap is folded by a forked paddle as the case begins to pass beneath the kicker carriage and, at an appropriate case location, a kicker kicks the rear flap forwardly. As the case proceeds further beneath the kicker carriage, glue heads are primed and actuated to apply glue at the front and, then rear glue locations. The glue patterns can be continuous or stitched, as desired. The front glue pattern is controlled by the associated front of box counter and the rear glue pattern is controlled by the appropriate flight bar counter. After passing beneath the kicker carriage, the case passes beneath a compression carriage that applies a vertical force that seals the top and/or bottom major and minor flaps together. As the case moves through the machine infeed, top and discharge rails are moved in to maintain case alignment along the centerline of the case path of travel through the machine. After their work is complete the rails are moved out. As previously noted, two cases can be simultaneously processed by the machine with the operation of the various mechanisms being individually controlled by the front of case and flight bar counters associated with each case.

While a preferred embodiment has been illustrated and described, it will be appreciated that various changes can be made therein without departing from the spirit and scope of the invention. For example, the counter test sequences can be changed, as noted above. Other changes that will be readily apparent to those familiar with microprocessor control systems also can be made. Moreover, while mechanical switches are preferred for sensing the position of various elements, obviously, other types of switches can be used, as desired. As a result, the invention can be practiced otherwise than as a specifically described herein.

The embodiments of the invention in which an exclusive property or privilege is claimed are defined as follows:

1. A programmable random size case sealing machine comprising:

(A) conveyor means for moving cases to be sealed along a path of travel;

(B) gate means located at the infeed end of said conveyor means for controlling the receipt of cases by said conveyor means;

(C) position adjustable case centering means for centering cases about said path of travel;

(D) position adjustable case sealing means located along said path of travel for selectively sealing the top and bottom of cases moved by said conveyor means;

(E) case position sensing means for sensing both the front and rear position of cases moved by said conveyor means;

(F) case infeed sensing means for sensing the presence of a case on the infeed side of said gate means;

(G) programming means for producing programming information for controlling predetermined operations of said random size case sealing machine; and (H) a central processing unit coupled to:

(1) said case position sensing means for receiving information about the front and rear position of cases moved by said conveyor means and updating said front and rear position information as said conveyor means moves cases along said path of travel so as to keep track of said front and rear case positions as cases are moved along said path of travel;

(2) said case infeed sensing means for receiving information about the presence of the case at the infeed side of said gate means;

(3) said programming means for receiving and storing said programming information;

(4) said gate means, for actuating said gate means to allow a case to be received by said conveyor means when said conveyor mens is in a predetermined position;

(5) said position adjustable case centering means for controlling said position adjustable case centering means to maintain cases received by said conveyor means centered about said path of travel; and, (6) said position adjustable case sealing means for controlling said position adjustable case sealing means so that the top and bottom of cases moved by said conveyor means along said path of travel are selectively sealed by said position adjustable case sealing means in accordance with the programming information received by said central processing unit from said programming means.

2. A programmable random size case sealing machine as claimed in claim 1 wherein said position adjustable case centering means is horizontally position adjustable and wherein said position adjustable case sealing means is vertically position adjustable.

3. A programmable random size case sealing machine as claimed in claim 1 wherein said case position sensing means includes:

a front of case switch for sensing when the front of a case reaches a predetermined position along said path of travel;

a synchronizing switch for sensing when said conveying means reaches a predetermined position along said path of travel; and, a pulse producing means connected to said conveyor means for producing pulse information as said conveyor means moves cases along said path of travel.

4. A programmable random size case sealing machine as claimed in claim 2 wherein said case position sensing means includes:

a front of case switch for sensing when the front of a case reaches a predetermined position along said path of travel;

a synchronizing switch for sensing when said conveying means reaches a predetermined position along said path of travel; and, a pulse producing means connected to said conveyor means for producing pulse information as said conveyor means moves cases along said path of travel.

5. A programmable random size case sealing machine as claimed in claim 4 wherein:

said pulse producing means produces a pulse for each incremental distance of movement of said conveyor means and, thus, said cases; and, said tracking means includes at least one front of case counter that is set to a predetermined state when said front of case switch senses that a case has reached a predetermined position along path of travel, and at least one rear of case counter that is set to a predetermined state when said conveyor means reaches a predetermined position along said path of travel, said front and rear of case counter being incremented by said pulses produced by said pulse producing means.

6. A programmable random size case sealing machine as claimed in claim 5 wherein said position adjustable case centering means includes rail means located along the path of travel and actuator means for moving said rail means toward and away from said path of travel, said actuator means coupled to said central processing unit for being actuated by said central processing unit when cases reach predetermined positions along said path of travel.

7. A programmable random size case sealing machine as claimed in claim 6 wherein said rail means includes infeed rails located immediately downstream of said gate means and discharge rails located downstream of said position adjustable case sealing means.

8. A programmable randon size case sealing machine as claimed in claim 6 wherein said position adjustable case sealing means includes a kicker carriage located downstream of said gate, a top glue head mounted on said kicker carriage and a kicker means mounted on said kicker carriage, said kicker means including a kicker and a kicker actuator, said kicker actuator coupled to said central processing unit for actuation by said central processing unit when a case reaches a predetermined position beneath said kicker carriage programmed via said programming means.

9. A programmable random size case sealing machine as claimed in claim 8 wherein said top glue head selectively emits glue in a continuous or intermittent pattern programmed via said programming means.

10. A programmable random size case sealing machine as claimed in claim 8 including a T-deck and a T-deck actuator, said T-deck being located beneath said path of travel, immediately downstream of said gate means, said T-deck actuator coupled to said central processing unit for actuation by said central processing unit to lower said T-deck after a case passes through said gate means, before said case reaches said kicker carriage.

11. A programmable random size case sealing machine as claimed in claim 10 including a bottom glue head located beneath said kicker carriage and in alignment with said T-deck for entering a space created between the bottom flaps of a case moving through said case sealing machines if the bottom major flaps of said case separate from the bottom minor flaps as a result of said T-deck being lowered by said central processing unit.

12. A programmable random size case sealing as claimed in claim 11 wherein said top and bottom glue heads selectively emit glue in a continuous or intermittent pattern programmed via said programming means.

13. A programmable random size case sealing machine as claimed in claim 8 wherein said rail means includes top rails mounted on said kicker carriage and movable toward and away from said path of travel.

14. A programmable random size case sealing machine as claimed in claim 8 wherein said position adjustable case sealing means also includes a compression carriage located downstream of said kicker carriage.

15. A programmable random size case sealing machine as claimed in claim 3 wherein:

said pulse producing means produces a pulse for each incremental distance of movement of said conveyor means and, thus, said cases; and, said tracking means includes at least one front of case counter that is set to a predetermined state when said front of case switch senses that a case has reached a predetermined position along said path of travel, and at least one rear of case counter that is set to a predetermined state when said conveyor means reaches a predetermined position along said path of travel, said front and rear of case counter being incremented by said pulses produced by said pulse producing means.

16. A programmable random size case sealing machine as claimed in claim 15 wherein said position adjustable case sealing means also includes a compression carriage located downstream of said kicker carriage.

17. A programmable random size case sealing machine as claimed in claim 15 wherein said position adjustable case sealing means includes a kicker carriage located downstream of said gate, a top glue head mounted on said kicker carriage and a kicker means mounted on said kicker carriage, said kicker means including a kicker and a kicker actuator, said kicker actuator coupled to said central processing unit for being actuated by said central processing unit when a case reaches a predetermined position beneath said kicker carriage programmed via said programming means.

18. A programmable random size case sealing machine as claimed in claim 15 wherein said position adjustable case centering means includes rail means located along the path of travel and actuator means for moving said rail means toward and away from said path of travel, said actuator means coupled to said central processing unit for actuating said central processing unit when cases reach predetermined positions along said path of travel.

19. A programmable random size case sealing machine is claimed in claim 18 wherein said rail means includes infeed rails located immediately downstream of said gate means and discharge rails located downstream of said position adjustable case sealing means.

20. A programmable random size case sealing machine as claimed in claim 17 including a T-deck and a T-deck actuator, said T-deck being located beneath said path of travel, immediately downstream of said gate means, said T-deck actuator coupled to said central processing unit for being actuated by said central processing unit to lower said T-deck after a case passes through said gate means before said case reaches said kicker carriage.

21. A programmable random size case sealing machine as claimed in claim 17 wherein said top glue head selectively emits glue in a continuous or intermittent pattern programmed via said programming means.

22. A programmable random size case sealing machine as claimed in claim 20 including a bottom glue head located beneath said kicker carriage and in alignment with said T-deck for entering a space created between the bottom flaps of a case moving through said case sealing machines if the bottom major flaps of said case separate from the bottom minor flaps as a result of said T-deck being lowered by said central processing unit.

23. A programmable random size case sealing as claimed in claim 22 wherein said to and bottom glue heads selectively emit glue in a continuous or intermittent pattern programmed via said programming means.

24. A programmable random size case sealing machine is claimed in claim 23 wherein said rail means includes infeed rails located immediately downstream of said gate means and discharge rails located downstream of said position adjustable case sealing means.

25. A programmable random size case sealing machine as claimed in claim 24 wherein said rail means also includes top rails mounted on said kicker carriage and movable toward and away from said path of travel.

* * * * *